US006474780B1

(12) United States Patent
Kubota et al.

(10) Patent No.: US 6,474,780 B1
(45) Date of Patent: Nov. 5, 2002

(54) LIQUID DISCHARGE HEAD, CARTRIDGE HAVING SUCH HEAD, LIQUID DISCHARGE APPARATUS PROVIDED WITH SUCH CARTRIDGE, AND METHOD FOR MANUFACTURING LIQUID DISCHARGE HEADS

(75) Inventors: Masahiko Kubota, Tokyo; Toshio Kashino, Chigasaki; Tomoyuki Hiroki, Zama; Teruo Ozaki, Yokohama; Takayuki Ono, Kawasaki; Masaru Iketani, Atsugi, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/291,032

(22) Filed: Apr. 14, 1999

(30) Foreign Application Priority Data

Apr. 16, 1998 (JP) ..... 10-106300
Jul. 15, 1998 (JP) ..... 10-200575

(51) Int. Cl.[7] ..... B41J 2/135
(52) U.S. Cl. ..... 347/45
(58) Field of Search ..... 347/45; 156/272.6, 156/273.3, 308.2, 308.6, 309.6

(56) References Cited

U.S. PATENT DOCUMENTS 4,743,327 A * 5/1988 DeHaan et al. ..... 156/272.6
5,059,973 A 10/1991 Watanabe ..... 346/1.1
5,362,525 A 11/1994 Nishii et al. ..... 427/554
5,374,948 A 12/1994 Saito et al. ..... 347/47
5,563,640 A * 10/1996 Suzuki ..... 347/45
5,649,359 A * 7/1997 Murakami et al. ..... 29/890.1
6,042,219 A * 3/2000 Higashino et al. ..... 347/47

FOREIGN PATENT DOCUMENTS

EP 0 531 535 A1 3/1993
EP 0 648 803 A1 4/1995
EP 0 659 549 A1 6/1995
EP 0 818 313 A2 1/1998
EP 0 842 776 A2 5/1998
JP 57-131568 8/1982
JP 57-157765 9/1982
JP 8-169117 7/1996
JP 8-187863 7/1996

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

An ink jet head comprises a head substrate provided with a plurality of ink paths, pressure generating elements each arranged for each of the paths; and an orifice plate provided with ink discharge openings each communicated with each of the ink paths. Then, the bonding surface side of the orifice plate to the substrate is provided at least with the surface treatment. The orifice plate is formed by fluororesin or resin containing fluorine. With the structure thus arranged, it becomes possible to bond the orifice plate having ink repellency to the head substrate firmly and assuredly, while enabling the ink jet head thus manufactured to maintain a good ink repellency for a long time.

11 Claims, 13 Drawing Sheets

LIQUID DISCHARGE HEAD, CARTRIDGE HAVING SUCH HEAD, LIQUID DISCHARGE APPARATUS PROVIDED WITH SUCH CARTRIDGE, AND METHOD FOR MANUFACTURING LIQUID DISCHARGE HEADS

BACKGROUND OF THE INVENTION

1. Field of the Invention

The present invention relates to a liquid discharge head and a head cartridge used for a printer, a video printer, or the like, which serves as an output terminal of a copying machine, a facsimile equipment, a wordprocessor, a host computer, or the like. The invention also relates to a liquid discharge apparatus provided with such liquid discharge head, and a method for manufacturing liquid discharge heads. More particularly, the invention relates to a liquid discharge head which discharges ink or some other liquid for use of recording as flying droplets from its discharge ports (orifices) to record by allowing such liquid to adhere to a recording medium. The invention also relates to a head cartridge and a liquid discharge recording apparatus provided with such head, as well as a method for manufacturing liquid discharge heads.

2. Related Background Art

Conventionally, an ink jet recording apparatus, which performs recording, as a liquid discharge recording apparatus, by discharging ink from the orifices of the liquid discharge head, is known as an excellent recording apparatus in that it has lower noises, and higher recording speeds, among some other advantages. As to the ink jet recording methods for such ink jet recording apparatuses, there have been proposed many methods, and some of them have been implemented as products and already put on the market after some improvements, while some of them are still under study at present for the implementation of its practical use.

As an example of the liquid discharge head used for the ink jet recording apparatus, there is one which is schematically shown in FIG. 1 and FIG. 2. FIG. 1 is a cross-sectional view which shows a part of the liquid discharge head manufactured by the conventional art. FIG. 2 is an exploded perspective view which schematically shows the liquid discharge head represented in FIG. 1.

As shown in FIG. 1 and FIG. 2, the conventional liquid discharge head comprises an orifice plate 440 having a plurality of discharge ports (orifices) 441 for discharging ink; a ceiling plate 400 for the formation of plural liquid flow paths 401 communicated with each of the discharge ports 441; and an elemental substrate 100 having a plurality of electrothermal transducing devices (heaters) 101 on it for the generation of thermal energy to discharge ink from the discharge ports 441. Therefore, the head is formed by the ceiling plate 400, and the head substrate 200 which is provided with the plural electrothermal converting elements 101 and liquid flow paths 401. Then, the orifice plate 400 is directly bonded to the head substrate 200 by use of bonding agent.

On the orifice plate 440, fine discharge ports 441 are formed for ink discharges as described above. Each of the discharge ports 441 is an important constituent of a liquid discharge head upon which its performance depends greatly. Then, in order to stabilize the directions in which ink droplets are discharged from each of the discharge ports 441, it is known that the circumference of each discharge port 441 of the orifice plate 440 should desirably be provided with the liquid repellency (hereinafter referred to as ink repellency or an ink repellent layer to make the description simpler) at least on its outer surface side. Therefore, it has been practiced to form the ink repellent layer on the surface of the orifice plate for the provision of the ink repellency on the circumference of each discharge port.

However, the outer surface 440*a* of the orifice plate where the ink repellent layer is formed is rubbed by the cleaning blade for wiping, which is needed for the maintenance of ink discharge condition by the execution of the recovery process thereof. As a result, there may be a case where the ink repellent layer is scraped by the cleaning blade and worn out or damaged depending on the material of the ink repellent layer, the formation method thereof, the material of the blade, or the like. Then, it is becomes difficult to maintain the ink repellency of the kind in good condition for a long time in some cases.

Therefore, attention has been given to this worn-out problem of the ink repellent layer, and for example, it has been proposed to disperse the ink repellent material in the material with which to form the orifice plate as disclosed in the specification of Japanese Patent Application Laid-Open No. 57-157765.

Nevertheless, when the material having ink repellency in it is used as the material of the orifice plate, there is encountered a new problem that in general, the higher the ink repellency contained in a material, the lower becomes the bonding power between the orifice plate and the head substrate. As a result, it has not been implemented as yet to provide a highly reliable liquid discharge head which is capable of maintaining the ink repellency of the orifice plate in good condition, while presenting the firm bonding between the orifice plate and the head substrate. This problem has been dealt with only by the improvement attempted to provide the ink repellent layer more effectively so far.

Under the circumstances, the inventors hereof have studies and acquired the knowledge that with the surface treatment given to the orifice plate at least on its bonding surface side, it becomes possible to bond the orifice plate with the head substrate in good condition even when adopting the fluororesin having an excellent ink repellency or the resin having the ink repellent material dispersed in it as the orifice plate material.

SUMMARY OF THE INVENTION

The present invention is designed with such new knowledge that the inventors hereof have acquired. It is an object of the invention to provide a liquid discharge head for which the bonding force is secured firmly between the head substrate, and the orifice plate having ink repellency on it to be made capable of maintaining a good ink repellency for a long time, and to provide a head cartridge using such head as well. It is also the object of the invention to provide a liquid discharge apparatus using such head, and a method for manufacturing ink jet heads.

In this respect, the orifice plate is a thin film sheet of approximately several tens of pm in some cases, depending on the modes to be adopted. Then, when resin or the like is used as the material of the orifice plate, the strength of the orifice plate becomes weaker to make its handling difficult. Also, the orifice plate is subjected to expansion or deformation due to heat if a high temperature treatment is given when the orifice plate is bonded to a head substrate. Particularly, since the thermal expansion coefficient is different depending on the material to be used, this phenomenon tends to exert influence on the bonding of the orifice plate and head substrate.

It is another object of the invention to provide a liquid discharge head whose orifice plate is capable of maintaining a good ink repellency for a long time even when a thin resin material having ink repellency or the like is used for the orifice plate which is bonded to the head substrate at a high temperature, and also, it is made possible to prevent the orifice plate from being expanded or deformed by the application of heat so as to bond the orifice plate assuredly to the head substrate. It is still another object of the invention to provide a head cartridge, a liquid discharge recording apparatus provided with such head, and a method for manufacturing liquid discharge heads as well.

In order to achieve the objects described above, an ink jet head of the present invention comprises a head substrate provided with a plurality of ink paths, and at the same time, each of the pressure generating devices being arranged for each of the paths; and an orifice plate provided with ink discharge openings each communicated with each of the ink paths. Then, the bonding surface side of the orifice plate to the substrate is provided at least with the surface treatment.

The orifice plate is resin containing fluorine.

The surface treatment provided for the fluororesin is plasma process, and fluororesin is coated on the bonding surface of the substrate to the orifice plate, and then, the plasma treatment is also given to the bonding surface of the substrate, hence bonding the orifice plate to the substrate by the self-bond thereof.

The surface treatment provided for the fluororesin is laser irradiation, and laser is also irradiated to the bonding surface of the substrate to the orifice plate, and then, the bonding surface of the orifice plate to substrate is activated and bonded.

The surface layer of the fluororesin is modified by the surface treatment for the provision of conductivity, and a metal plating process is performed for the conductive layer to be bonded to the substrate using a bonding agent.

Also, in order to achieve the object described above, the method for manufacturing ink jet heads of the present invention comprises the steps of preparing a head substrate provided with a plurality of ink paths and pressure generating devices each arranged for each of the paths; preparing an orifice plate provided with ink discharge openings communicated with each of the ink paths and bonded to the head substrate; performing the surface treatment on the bonding surface side of the orifice plate to the substrate; and bonding the orifice plate and the head substrate.

The orifice plate is resin containing fluorine, and plasma process is provided for the fluororesin, at the same time, coating fluororesin on the bonding surface of the substrate to the orifice plate, with the plasma treatment being also provided for the bonding surface of the substrate to enable the orifice plate and substrate to be bonded by the self-bond.

The orifice plate is resin containing fluorine, and Ar laser is irradiated to the fluororesin, and at the same time, the Ar laser being irradiated to the bonding surface of the substrate to the orifice plate to activate the bonding surface of the orifice plate to substrate for bonding.

The orifice plate is resin containing fluorine, and the surface layer of the fluororesin is modified for the provision of conductivity, and a metal plating process is performed for the conductive layer to be bonded to the substrate using a bonding agent.

Also, in order to achieve the objects described above, the liquid discharge head of the present invention comprises a head substrate provided with a plurality of discharge energy generating elements for generating thermal energy to create bubbles in liquid, and a plurality of liquid flow paths having the discharge energy generating elements arranged therefor; and an orifice plate formed by material having ink repellency, and provided with a plurality of ink discharge ports each communicated with each of the ink flow paths, at the same time, being bonded to the head substrate. Then, the orifice plate is bonded to the head substrate by the self-bond thereof.

In accordance with the invention described above, two substances are bonded by the molecular chains which are diffused each other when the head substrate and the orifice plate are bonded together. With the orifice plate being bonded by the so-called self-bond thereof, it becomes possible to secure the bonding force between the orifice plate having ink repellency and the head substrate even when fluororesin or the like which has ink repellency is used as the material of the orifice plate, for example. Also, by use of such orifice plate that has ink repellency, it becomes possible to obtain a liquid discharge head which is capable of stabilizing the discharge direction of ink discharged from the discharge ports formed on the orifice plate, at the same time, maintaining a good ink repellency for a long time. Further, since the orifice plate is bonded to the head substrate by the self-bond thereof assuredly, it becomes possible to reduce the influence that may be exerted by the thermal expansion of each of the structural parts of the liquid discharge head due to heat generated by the discharge energy generating elements when driving the liquid discharge head, hence obtaining the liquid discharge head whose discharge characteristics are stabilized.

It is preferable to use fluororesin as the material of the orifice plate. With the fluororesin used as the material of the orifice plate, it becomes possible to provide the orifice plate with ink repellency so as to stabilize the discharge direction of ink discharged from the discharge ports of the orifice plate.

Also, the liquid discharge head may be structured with an elemental substrate having a plurality of the discharge energy generating elements on the surface thereof, and a ceiling plate having a plurality of grooves constituting each of the liquid flow paths, and bonded to the surface of the elemental substrate.

Further, there may be provided a plurality of movable members arranged on the elemental substrate to face each of the discharge energy generating elements, and one end of them is fixed on the upstream side of the advancing direction of liquid in the each of liquid flow paths, and the other end thereof is made free.

It is also preferable to form the recessed portions on the bonding surface of the head substrate to the orifice plate, and the extrusions on the orifice plate in the state of being fitted into the recessed portions when the orifice plate is bonded to the head substrate.

It is also preferable to form the recessed portions on bonding surface of the head substrate to the orifice plate, and with the extrusions fitted into the recessed portions being formed on the orifice plate, it becomes possible to position the orifice plate by fitting the recessed portions and the extrusions when the orifice plate is bonded to the head substrate.

It is preferable to form the extrusions of the orifice plate and the discharge ports by the etching process using high-luminance X rays.

Also, the head cartridge of the present invention comprises a liquid discharge head, and a liquid container holding liquid to be supplied to the liquid discharge head.

In accordance with the present invention, since the head cartridge is provided with the above-described liquid discharge head, it is possible to obtain a highly reliable head cartridge.

Further, the liquid discharge recording apparatus of the present invention comprises the above-described liquid discharge head, and a recording medium supplying device for carrying a recording medium receiving liquid discharged from the liquid discharge head.

In accordance with the present invention, it is possible to obtain the liquid discharge recording apparatus capable of recording in good condition for a long time, because as described above, the apparatus is provided with the liquid discharge head whose orifice plate can maintain the good ink repellency for a long time, and at the same time, the bonding force between the orifice plate and the head substrate is assuredly secured. Also, the liquid discharge recording apparatus thus obtained is capable of recording on a recording medium stably against the temperature changes or the like.

Further, the method for manufacturing liquid discharge heads of the present invention comprises the steps of bonding an orifice plate formed by material having ink repellency, and provided with a plurality of ink discharge ports each communicated with each of the ink flow paths to a head substrate provided with a plurality of discharge energy generating elements for generating thermal energy to create bubbles in liquid, and the liquid flow paths having the discharge energy generating elements arranged therefor. With this method, the orifice plate is bonded to the head substrate by the self-bond thereof.

In accordance with the present invention, the orifice plate is bonded to the head substrate by the self-bond thereof. Therefore, as described earlier, when fluororesin or the like is used as the material of the orifice plate, it is possible to bond assuredly the orifice plate having ink repellency to the head substrate. Also, it is possible to reliably bond the orifice plate to the circumferential portions of the liquid flow paths on the bonding surface of the head substrate to the orifice plate. Therefore, at the same time that the orifice plate can maintain a good ink repellency for a long time, it becomes possible to reduce the influence that may be exerted by the thermal expansion of each of the structural parts of the liquid discharge head due to heat generated by the discharge energy generating elements when driving the liquid discharge head, hence obtaining the liquid discharge head whose discharge characteristics are stabilized.

For the above-described method for manufacturing liquid discharge heads, it is preferable to use fluororesin as the material of the orifice plate. With the fluororesin used as the material of the orifice plate, it becomes possible to manufacture the liquid discharge head capable of stabilizing the discharge direction of ink discharged from the discharge ports formed on the orifice plate, and at the same time, the orifice plate of which is able to maintain a good ink repellency for a long time.

More precisely, this method for manufacturing liquid discharge heads comprises the steps of transferring or coating fluororesin to the bonding surface of the head substrate to the orifice plate; performing the graft polymerization on the bonding surface of the head substrate having the fluororesin transferred or coated thereon, and the bonding surface of the orifice plate to the head substrate; and heating the bonding surface of the head substrate having the fluororesin transferred or coated thereon, and the bonding surface of the orifice plate to the head substrate, and bonding under pressure the bonding surfaces of the head substrate and the orifice plate themselves.

Further, it is preferable to form recessed portions on the bonding surface of the head substrate to the orifice plate, and extrusions on the orifice plate to be fitted into the recessed portions in the state of the head substrate being bonded to the orifice plate; and positioning the head substrate and the orifice plate by fitting the recessed portions and the extrusions together when the head substrate is bonded to the orifice plate. Here, it is also preferable that before the step of bonding the head substrate and the orifice plate by the self-bond thereof, the extrusions and the discharge ports on the orifice plate are formed by etching process using high-luminance X rays.

As described above, when the orifice plate is bonded to the head substrate, the extrusion formed on the orifice plate is fitted into the recessed portion formed on the bonding surface of the head substrate to the orifice plate for positioning the head substrate and the orifice plate. As a result, there is no need for a complicated apparatus that performs image process or the like for such positioning operation, and the liquid discharge head can be manufactured by use of a simpler apparatus. Also, with the formation of the extrusions and the discharge ports on the orifice plate by the etching process using the high-luminance X rays before the head substrate is bonded to the orifice plate, it is possible to form the discharge ports on the orifice plate in high precision and high density, because the mask adopted for the etching process is produced by the photolithographic process. As a result, it becomes possible to form the extrusions and the discharge ports in high precision and high density.

Further, in order to achieve the above-described objects, the liquid discharge head of the present invention comprises a head substrate provided with a plurality of discharge energy generating elements for generating thermal energy to create bubbles in liquid, and a plurality of liquid flow paths having the discharge energy generating elements arranged therefor; and an orifice plate formed by material having ink repellency, and provided with a plurality of ink discharge ports each communicated with each of the ink flow paths, at the same time, being bonded to the head substrate. For this liquid discharge head, the orifice plate is provided with the plate member having ink repellency, at the same time, the discharge ports being formed thereon, and an reinforcement member for reinforcing the plate member.

In accordance with the invention described above, the orifice plate is provided with the plate member having ink repellency and the reinforcement member that reinforces the plate member. As a result, even if a thin resin material is used for the plate member, for example, the strength of the orifice plate has been enhanced to make it possible to prevent the plate member from being deformed due to head when the orifice plate is bonded to the head substrate by a high-temperature process. With the prevention of the deformation of the plate member where the discharge ports are formed, it becomes possible to bond the orifice plate to the head substrate assuredly by a high-temperature process without spoiling the discharge characteristics, and at the same time, it is possible to obtain a highly reliable liquid discharge head which is sufficiently capable of coping with the environmental changes due to heat or the like. Also, when the orifice plate is provided with such plate member having ink repellency, the discharge direction of ink, which is discharged from the discharge ports formed on the plate member, is stabilized to make it possible to obtain the liquid discharge head whose orifice plate is capable of maintaining a good ink repellency for a long time.

It is also preferable to form recessed portions on the bonding surface of the head substrate to the orifice plate, and the extrusions fitting into the recessed portions on the orifice plate for positioning the head substrate and the orifice plate.

As described above, with the formation of the recessed portions on the bonding surface of the head substrate to the orifice plate, and also, the formation of the extrusions on the orifice plate to fit into such recessed portions, it becomes possible to position the orifice plate by fitting the extrusions into the recessed portions when the orifice plate is bonded to the head substrate.

More precisely, it is preferable that the reinforcement member is a metal layer formed on one surface of the plate member, and the orifice plate is provided with the double layer structure formed by the layer of the plate member having ink repellency, and the metal layer.

Also, it is preferable that fluororesin or the like is used as the material of the plate member, and that the discharge ports on the orifice plate are formed by the etching process using high-luminance X rays.

Also, it may be possible to structure with the head substrate comprising the elemental substrate having a plurality of discharge energy generating elements provided for the surface thereof, and a ceiling plate having a plurality of grooves constituting each of the liquid flow paths thereon, and bonded to the surface of the elemental substrate.

Further, the liquid discharge head may be able to further comprise a plurality of movable members arranged on the elemental substrate to face the discharge energy generating elements, respectively, at the same time, one end of each of them being fixed on the upstream side in the advancing direction of liquid in the liquid flow path, and the other end thereof is made free.

Also, the head cartridge of the present invention comprises the abode-described liquid discharge head, and a liquid container for holding liquid to be supplied to the liquid discharge head.

In accordance with the present invention, since the head cartridge is provided with the liquid discharge head described earlier, it is possible to sufficiently cope with the environmental changes due to heat or the like, and to obtain a highly reliable head cartridge whose discharge characteristics are stabilized.

Furthermore, the liquid discharge recording apparatus of the present invention comprises the above-described liquid discharge head, and a recording medium supply device for carrying the recording medium for receiving liquid discharged from the liquid discharge head.

Also, the method for manufacturing liquid discharge heads of the present invention comprises the step of bonding an orifice plate provided with a plurality of discharge ports communicated with the liquid flow paths, respectively, to a head substrate provided with a plurality of discharge energy generating elements to generate thermal energy for the creation of bubbles in liquid, and the liquid flow paths having the discharge energy generating elements, respectively.

This method further comprises the steps of preparing a plate member having ink repellency for the manufacture of the orifice plate; forming an reinforcement member on the surface of the plate member having ink repellency for reinforcing the plate member; and manufacturing the orifice plate having the plate member and the reinforcement member provided therefor.

In accordance with the invention described above, the orifice plate is provided with the plate member having ink repellency and the reinforcement member that reinforces the plate member. As described earlier, therefore, even if a thin resin material is used for the plate member, for example, the strength of the orifice plate has been enhanced to make it possible to prevent the plate member from being deformed due to head by use of the reinforcement member when the orifice plate is bonded to the head substrate by a high-temperature process. Therefore, it becomes possible to manufacture a highly reliable liquid discharge head without spoiling the discharge characteristics. Also, it is possible to manufacture a liquid discharge head whose orifice plate can maintain a good ink repellency for a long time, and whose discharge characteristics are stabilized at the same time, with the reduction of the influence that may be exerted by thermal expansion of each of the structural parts of the liquid discharge head due to head of the discharge energy generating elements when driving them.

More precisely, the method for manufacturing liquid discharge heads further comprises the steps of modifying the surface layer of the plate member to be the layer having conductivity for the formation of the reinforcement member on the surface of the plate member; and forming the reinforcement member on the surface of the plate member using a plating method with the surface layer of the plate member as the cathode.

As described above, with the formation of the reinforcement member formed by the plating method, it becomes easier to handle the reinforcement member of several tens of $\mu$m thick, and the temperature resistance of the orifice plate is enhanced against the heat treatment. Also, the orifice plate having the reinforcement member with it can be manufactured by use of a simpler apparatus.

It is preferable to use fluororesin as the material of the plate member. In this way, the circumferential portions of the discharge ports on the orifice plate are provided with ink repellency, to stabilize the discharge direction of ink discharged from the discharge parts on the orifice plate, and the same time, it becomes possible to manufacture the liquid discharge head whose orifice plate can maintain a good ink repellency for a long time.

Further, it is preferable to form the recessed portions on the bonding surface of the head substrate to the orifice plate, and the extrusions on the orifice plate in the state of being fitted into the recessed portions when the orifice plate is bonded to the head substrate, thus positioning the head substrate and the orifice plate by fitting the extrusions and recessed portion when the orifice plate is bonded to the head substrate. Here, it is preferable to form the extrusions of the orifice plate and the discharge ports by the etching process using high-luminance X rays.

As described above, when the orifice plate is bonded to the head substrate, the extrusions formed on the orifice plate are fitted into the recessed portions formed on the substrate, thus positioned the head substrate and the orifice. As a result, there is no need for the use of any complicated apparatus that performs image process or the like for positioning. With a simpler apparatus, the positioning is possible. Also, the discharge ports on the orifice plate are formed by etching process using high-luminance X rays, and the mask used for such etching is produced by the lithographic process. Therefore, it becomes possible to form the discharge ports in high precision and high density.

DETAILED DESCRIPTION OF THE PREFERRED EMBODIMENTS

Now, with reference to the accompanying drawings, the embodiments will be described in accordance with the present invention.

Figure 1:
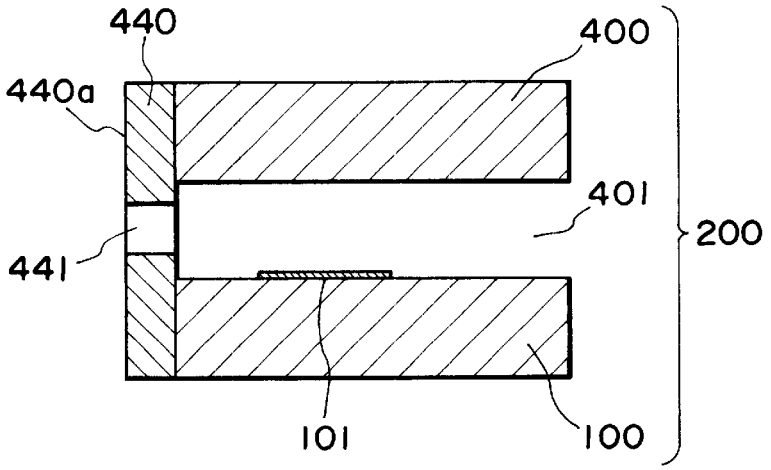
PRIOR ART FIG. 1
FIG. 1 is a cross-sectional view which shows the liquid discharge head manufactured by the conventional art.
Figure 2:
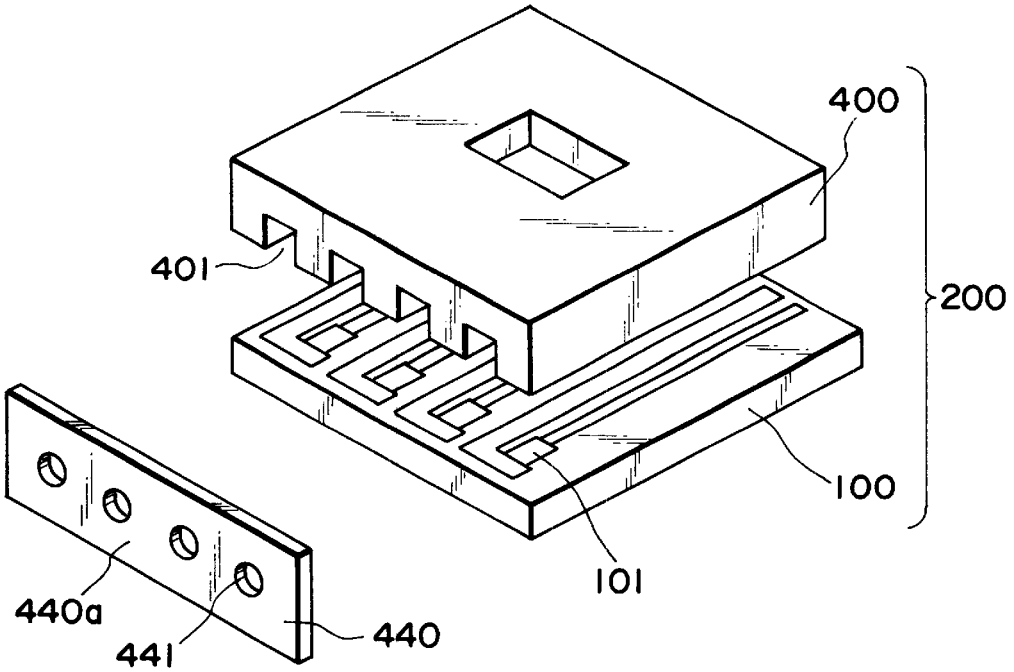
PRIOR ART FIG. 2
FIG. 2 is an exploded perspective view which shows the liquid discharge head represented in FIG. 1.
Figure 3:
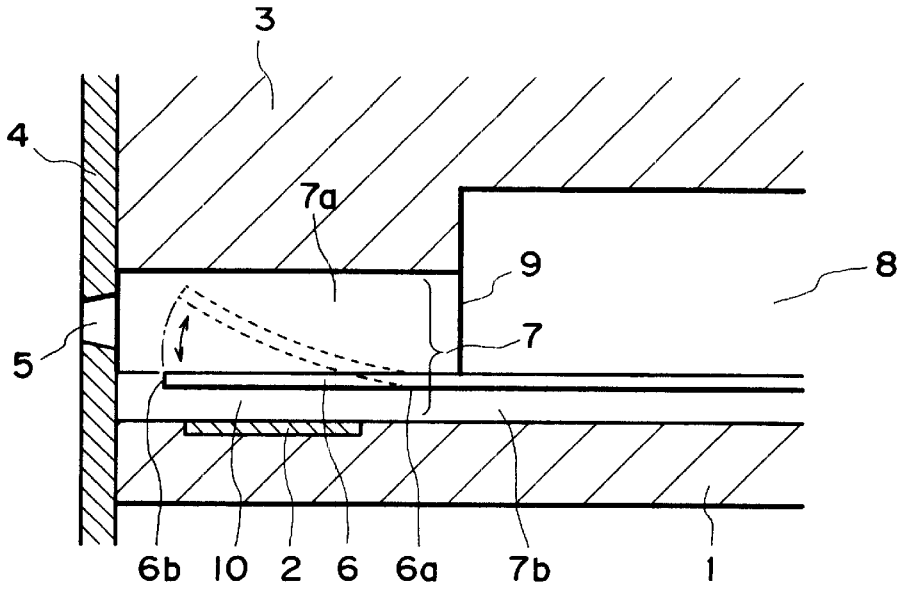
FIG. 3 is a cross-sectional view which illustrates the fundamental structure of the liquid discharge head in accordance with one embodiment of the present invention.

FIG. 3 is a view which illustrates one example of the fundamental structure of the liquid discharge head in accordance with one embodiment of the present invention, taken in the direction of the liquid flow path. In accordance with the present embodiment, the liquid discharge head comprises, as shown in FIG. 3, an elemental substrate 1 having a plurality of heat generating devices 2 (in FIG. 3, only one of them is shown) arranged in parallel to serve as the discharge energy generating elements for applying thermal energy to the liquid for the creation of bubbles; a ceiling plate 3 bonded to the elemental substrate 1; and an orifice plate 4 bonded to the front end of the elemental substrate 1 and the ceiling plate 3.

As described later, the elemental substrate 1 is formed in such a manner that on the silicon substrate or the like, silicon oxide film or silicon nitride film is formed for the purpose of insulation and heat accumulation, and on such film, the electric resistance layer and wiring are patterned to form each of the heat generating devices 2. When voltage is applied to this electric resistance layer through the wiring, the heat generating device 2 gives heat with the electric current thus flowing on the electric resistance layer. Also, on the wiring and the electric resistance layer, a protection film is formed to protect them from ink. Further, on the protection film, a cavitation proof film is formed to protect it from cavitation caused by the ink defoaming.

The ceiling plate 3 is the plate that forms a plurality of liquid flow paths 7 corresponding to each of the heat generating devices 2, and a common liquid chamber 8 from which liquid is supplied to each of the liquid flow paths 7. Each of the flow path walls 9, which extends from the ceiling portion between each of the heat generating devices 2, is integrally arranged. The ceiling plate 3 is formed by silicon material, and the patterns of the liquid flow paths 7 and the common liquid chamber 8 may be formed by etching or the portion of the liquid flow paths 7 may be formed by etching after the silicon nitride or silicon oxide is deposited by CVD or some other known film formation method as the material that forms each of the flow path walls 9.

On the orifice plate 4, there are formed a plurality of discharge ports 5 communicated with the common liquid chamber 8 through each of the liquid flow paths 7. As the material of the orifice plate 4, fluororesin is used. With the fluororesin material used for the orifice plate 4, ink repellency is provided for the orifice plate 4, and by this ink repellency, the discharge direction of ink is stabilized when discharged from each of the discharge ports 5.

When the elemental substrate 1 and the ceiling plate 3 are bonded together, the head substrate is formed with a plurality of heat generating devices 2 and liquid flow paths 7. Then, the fluororesin orifice plate is bonded to the front end of the head substrate directly or through a metal-plated layer as described later.

Further, for the liquid discharge head, movable members 6 are arranged each in a cantilever fashion to face each of the heat generating devices 2 so as to separate the first liquid flow paths 7*a,* and the second liquid flow paths 7*b* which are provided with the heat generating devices 2, respectively. The movable member 6 is a thin film formed by silicon materials, such as silicon nitride or silicon oxide.

The movable member has a fulcrum 6*a* on the upstream side of a large flow that runs by the liquid discharge operation from the common liquid chamber 8 to the discharge port side through the movable member 6. Then, the movable member is arranged in a position to face the heat generating device 2 to cover the heat generating device 2 with a specific gap with the heat generating device 2 so as to be able to provide the free end 6*b* on the downstream side with respect to the fulcrum 6*a*. This gap between each of heat generating devices 2 and movable members 6 becomes the bubble generating area 10, respectively.

With the structure arranged as described above, when the heat generating device 2 is energized, heat is caused to act upon the liquid residing in the bubble generating area 10 between the movable member 6 and the heat generating device 2. Then, by the film boiling phenomenon, bubble is created and developed on the heat generating device 2. The pressure exerted along the development of this bubble acts upon the movable member 6 priority, and as indicated by broken line in FIG. 3, the movable member is displaced so that it opens largely to the discharge port 5 side centering on the fulcrum 6*a*. With this displacement of the movable member 6 or by the displaced condition thereof, the propagation of the pressure exerted by the creation of the bubble or the development of the bubble itself is directed to the discharge port 5 side, thus discharging the liquid from the discharge port 5.

In other words, with the arrangement of the movable member 6 having the fulcrum 6*a* on the upstream side (the common liquid chamber 8 side) and the free end 6*b* on the down stream side (the discharge port 5 side) in the flow of liquid in the liquid flow path 7, the propagating direction of the pressure exerted by bubble is guided to the downstream side, hence enabling the pressure of bubble to contribute directly to the discharge of liquid efficiently. Then, the development direction of the bubble itself is also guided to the downstream side as in the propagating direction of the pressure, thus enabling the bubble to be developed larger on the downstream side than on the upstream side. In this way, the developing direction of the bubble itself is also controlled by the provision of the movable member, hence controlling the propagating direction of the pressure exerted by the bubble. With this arrangement, it becomes possible to enhance the fundamental discharge characteristics, such as the discharge efficiency and discharge power.

On the other hand, when the bubble enters the disappearing process, the bubbles rapidly disappears with the multiple effect produced by the resultant elasticity of the movable member 6. Lastly, therefore, the movable member returns to the initial position indicated by solid line in FIG. 3. At this juncture, in order to compensate the voluminal quantity of the liquid which has been discharged, liquid is allowed to flow in from the upstream side, that is, the common liquid chamber 8 side to perform the refilling of the liquid in the liquid flow path 7. This liquid refilling is executed rationally and stably along with the returning operation of the movable member 6 efficiently.

Figure 4:
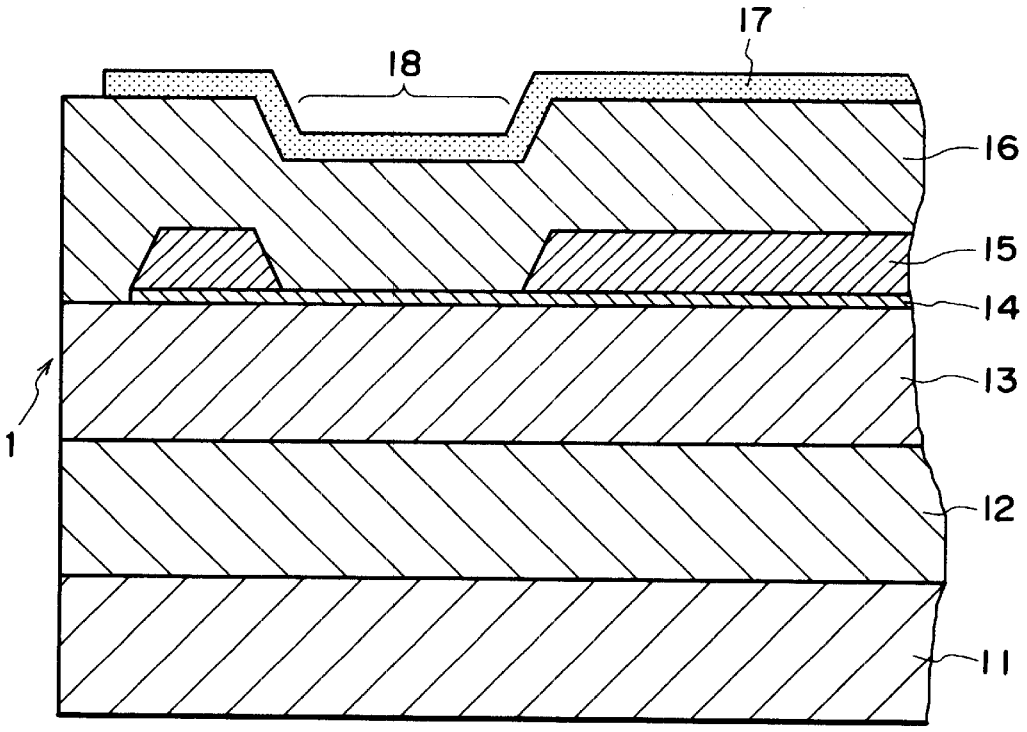
FIG. 4 is a cross-sectional view which shows the elemental substrate represented in FIG. 3.

FIG. 4 is a cross-sectional view which shows the elemental substrate 1 represented in FIG. 3. As shown in FIG. 4, the elemental substrate 1, there are provided on the surface of the silicon substrate 11 a thermal oxidation film 12 serving as the heat accumulation layer, and an interlayer film 13 which dually serves as the heat accumulation layer in that order. As the heat accumulation layer 12, $SiO_2$ film or $Si_3N_4$ film is used. On the surface of the interlayer film 13, a resistance layer 14 is partly formed. On the surface of the resistance layer 14, a wiring 15 is partly formed. As the wiring 15, Al or Al—Si, Al—Cu or some other Al alloy is used. On the surface of the wiring 15, the resistance layer 14, and the interlayer 13, there is formed the protection film 16, which is made by $SiO_2$ film or $Si_3N_4$ film. On the surface portion of the protection film 16 which corresponds to the resistance layer 14 and the circumference of such portion, the cavitation proof film 17 is formed to protect the protection film 16 from the chemical and physical shocks given following the heat generation of the resistance layer 14. The area on the surface of the resistance layer 14 where the wiring 15 is not formed is the heat activation portion 18. The heat of the resistance layer 14 is caused to act upon this area.

Each of the films on the elemental substrate 1 is formed one after another on the surface of the silicon substrate 11 by the application of the semiconductor manufacturing technologies and techniques, and the heat activation portion 18 is provided on the silicon substrate 11.

Figure 5:
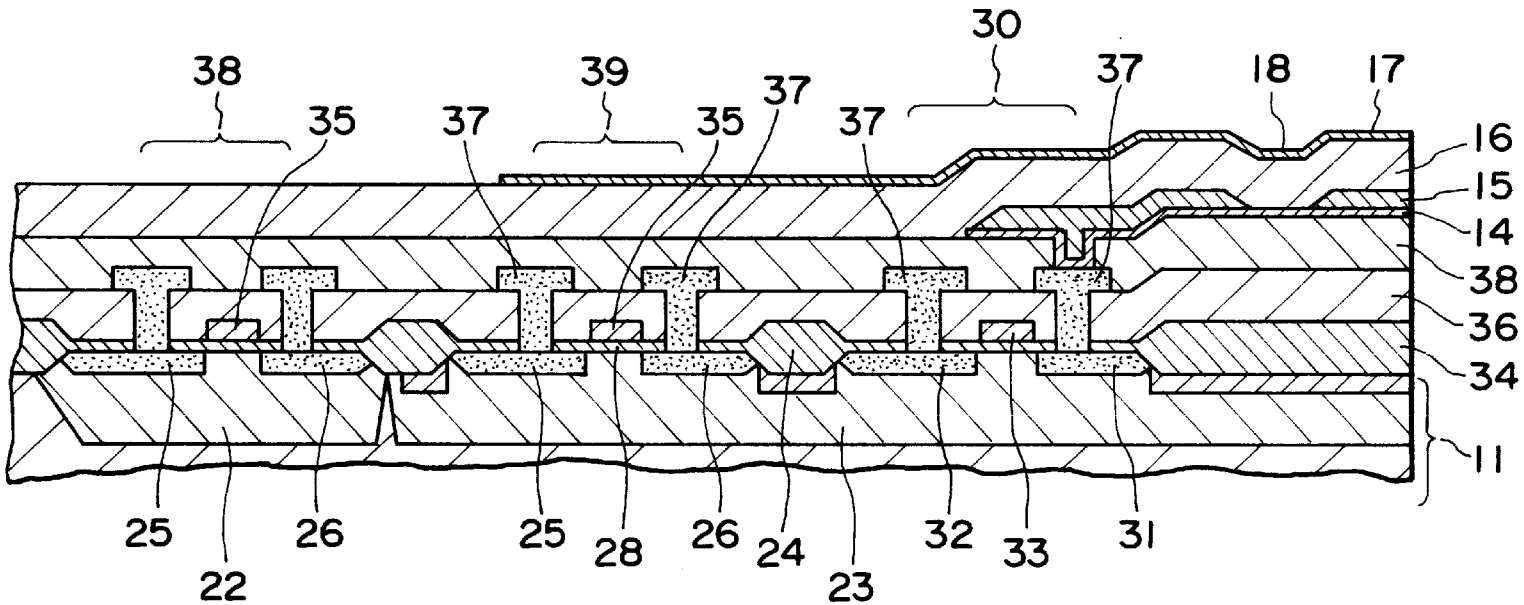
FIG. 5 is a cross-sectional view which shows the driving device sectionally in the vertical direction of the main device thereof represented in FIG. 3 and FIG. 4.

FIG. 5 is a cross-sectional view which shows the driving device sectionally in the vertical direction of the main device thereof represented in FIG. 3 and FIG. 4.

As shown in FIG. 5, on the surface of the silicon substrate 11 which is the P conductor, the N type well region 22 and the p type well region 23 are partly provided. Then, using the general MOS process the impurity installation such as ion plantation and its diffusion are conducted to form the P-MOS 38 on the N type well region 22, and the N-MOS 39 on the P type well region 23, respectively. The P-MOS 38 comprises, among some others, the source region 25 where the N-type or P-type impurity is implanted partly on the surface layer of the N type well region 22, and the drain region 26, and also, the gate wiring 35 which is deposited through the gate insulation film 28 in the thickness of several hundreds Å on the surface of the N type well region 22 other than the source region 25 and the drain region 26. Also, the N-MOS 39 comprises, among some others, the source region 25 where the N-type or P-type impurity is implanted partly on the surface layer of the P type well region 23, and the drain region 26, and also, the gate wiring 35 which is deposited through the gate insulation film 28 in the thickness of several hundreds Å on the surface of the N type well region 22 other than the source region 25 and the drain region 26. The gate wiring 35 is formed by polysilicon deposited by CVD method in a thickness of 4,000 Å to 5,000 Å. Then, the C-MOS logic is structured by these P-MOS 38 and N-MOS 39.

In accordance with the present embodiment, the N-MOS transistor 30 is provided for the portion of the P type well region 23 to drive the electrothermal converting elements. However, the transistor is not necessarily limited to it. Any type of transistor will do if only it should be capable of driving a plurality of electrothermal converting elements individually, and such transistor makes it possible to form the structure as fine as the one described above.

Between each of the devices, such as between the P-MOS 38 and the N-MOS 39 or the N-MOS 39 and the MOS transistor 30, there is formed an oxidized film separation region 24 in a thickness of 5,000 Å to 10,000 Å by the application of the field oxidation. Then, by this oxidized film separation region 24, each of the devices is separated. The portion which corresponds to the heat activation portion 18 serves as the heat accumulation layer 34 on the first layer, observed from the surface side of the silicon substrate 11.

On the surface of each devices, P-MOS 38, N-MOS 39, and N-MOS transistor 30, the interlayer insulation film 36 are formed by CVD method with the PSG film or the BPSG film in a thickness of approximately 7,000 Å. After the interlayer insulation film is smoothed by the application of a heat treatment, the wiring is executed using the Al electrodes 27, which serve as the first wiring layer, through the contact hole that penetrates the interlayer insulation film 36 and the gate insulation film 28. On the surface of the interlayer insulation film 36 and the Al electrodes 37, the interlayer insulation film 38 is formed by plasma CVD method with $SiO_2$ film in a thickness of 10,000 Å to 15,000 Å. The portion of the surface of the interlayer insulation film 38, which corresponds to the heat activation portion 18 and the N-MOS transistor 30, the resistance layer 14 is formed by DS sputtering method with the $TaN_{0.8,hex}$ film in a thickness of approximately 1,000 Å. The resistance layer 14 is electrically connected with the Al electrodes 37 in the vicinity of the drain region 31 by way of the through hole formed on the interlayer insulation film 38. On the surface of the resistance layer 14, the Al wiring 15 is formed to serve as the second wiring layer which becomes the wiring for each of the electrothermal converting elements.

The protection film 16, which is formed on the surface of wiring 15, resistance layer 14, and interlayer insulation film 38, is the $Si_3N_4$ film formed by plasma CVD method in a thickness of 10,000 Å. The cavitation proof film 17 on the surface of the protection film 16 is formed by Ta film or the like in a thickness of approximately 1,500 Å.

Figure 6:
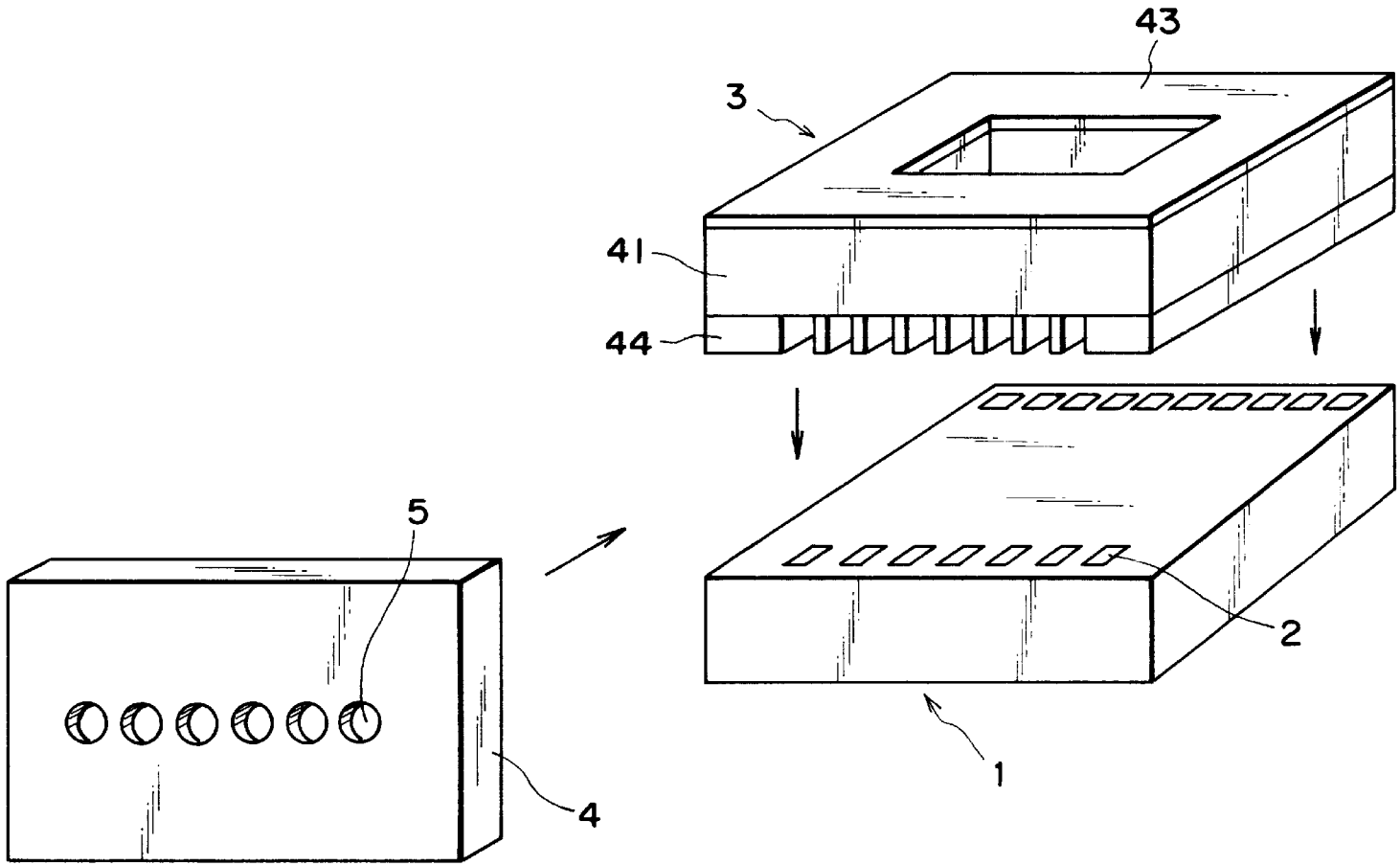
FIG. 6 is a perspective view which schematically shows each of the structural parts of the liquid discharge head by partly disassembling the liquid discharge head represented in FIG. 3.

FIG. 6 is a perspective view which schematically shows each of the structural parts of the liquid discharge head by partly disassembling the liquid discharge head represented in FIG. 3. On the surface of the ceiling plate 3 on the elemental substrate 1 side, the flow path side walls 9 are structured as shown in FIG. 3, and the SiN film 44 is formed to provide a plurality of the first liquid flow paths 7*a*. On the surface of the ceiling plate 3 opposite to the elemental substrate 1 side, the $SiO_2$ film 43 is formed. Also, on the surface of the elemental substrate 1, a plurality of heat generating devices 2 are arranged in parallel corresponding to each of the plural first liquid flow paths 7*a*. Meanwhile, on the orifice plate 4, the discharge ports 5 are arranged in a line corresponding to each of the plural first liquid flow paths 7*a*. In FIG. 6, the movable members 6 and the second liquid flow paths 7*b*, which are shown in FIG. 3, are omitted.

Figure 7A:
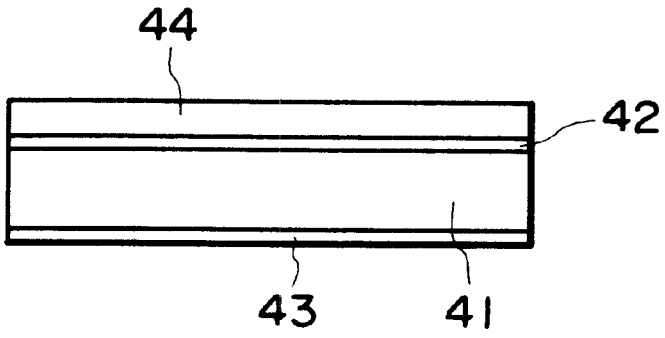
FIGS. 7A and 7B are views which illustrate the method for manufacturing a ceiling plate represented in FIG. 3 and FIG. 6.
Figure 7B:
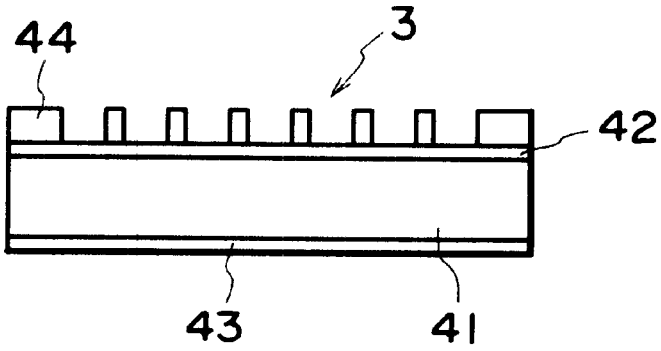
Figure 8:
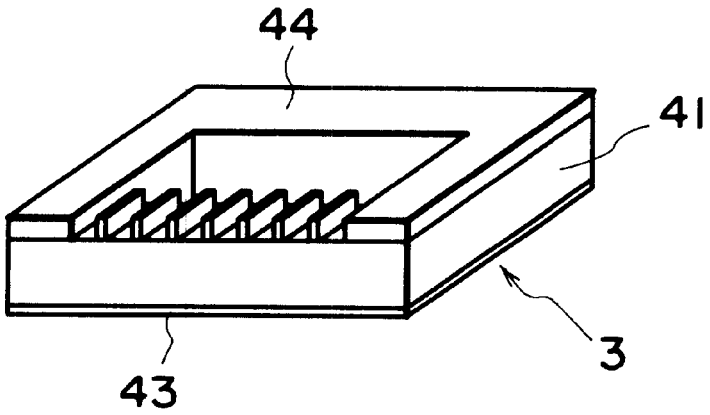
FIG. 8 is a perspective view which shows the ceiling plate manufactured through each step of the manufacture method illustrated in FIGS. 7A and 7B.

Now, FIGS. 7A and 7B are views which illustrate the method for manufacturing the ceiling plate 3 shown in FIG. 3 and FIG. 6. FIG. 8 is a perspective view which shows the ceiling plate 3 manufactured through each of the steps of the method of manufacture illustrated in accordance with FIGS. 7A and 7B.

At first, on one surface of the silicon wafer 41 shown in FIG. 7A, the $SiO_2$ film 42 is formed, and on the other surface of the silicon wafer 41, the $SiO_2$ film 43 is formed in a thickness of approximately 1 $\mu$m by the application of the thermal oxidation, respectively. Then, on the surface of the $SiO_2$ film 42, there is patterned the portion corresponding to the common liquid chamber 8 shown in FIG. 3 by the photo-lithography or some other known method. Further thereon, the SiN film 44 is formed in a thickness of approximately 20 $\mu$m by the microwave plasma CVD method, which becomes the flow path walls 9 as shown in FIG. 3. Here, the gases used for the formation of the SiN film 44 by the microwave plasma CVD method are monosilane ($SiH_4$), nitrogen ($N_2$), and argon (Ar). However, as the combination of gases, it may be possible to use disilane ($Si_2H_6$), ammonia ($NH_3$), or the like, or it may be possible to use mixed gas. Also, the SiN film 44 is formed in the vacuum having a pressure of 5 mTorr with the power of the microwave of 1.5 kW at a frequency of 2.45 GHz. Here, the gasses are supplied at its flow rate of 100 sccm for monosilane, 100 sccm for nitrogen, and 40 sccm for argon. Also, it may be possible to form the SiN film 44 using the microwave plasma CVD method whose gas composition ratio is other than the one mentioned above, or the CVD method that uses RF power-supply.

Then, in order to remove the portion of the SiN film 44, which corresponds to the first liquid flow paths 7*a* shown in FIG. 3, the SiN film 44 is patterned by use of the known method, such as photolithography.

After that, using the etching apparatus, which adopts dielectric coupling plasma, etching is performed to remove the portion that corresponds to the first liquid flow paths 7*a* in the form of grooves as shown in FIG. 7B. In this manner, the trench structure is formed on the SiN film 44. Then, a part of the portion, where the common liquid chamber 8 is formed on the silicon wafer 41, is removed by etching which uses TMAH (texamethyl ammonium hydride) in order to cause such portion of the silicon wafer to be penetrated. In this way, the ceiling plate 3 is manufactured as shown in FIG. 8.

Figure 9A:
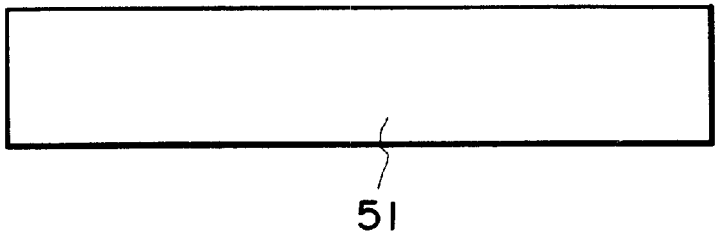
FIGS. 9A, 9B and 9C are views which illustrate the manufacturing method of the orifice plate represented in FIG. 3 and FIG. 6.
Figure 9B:
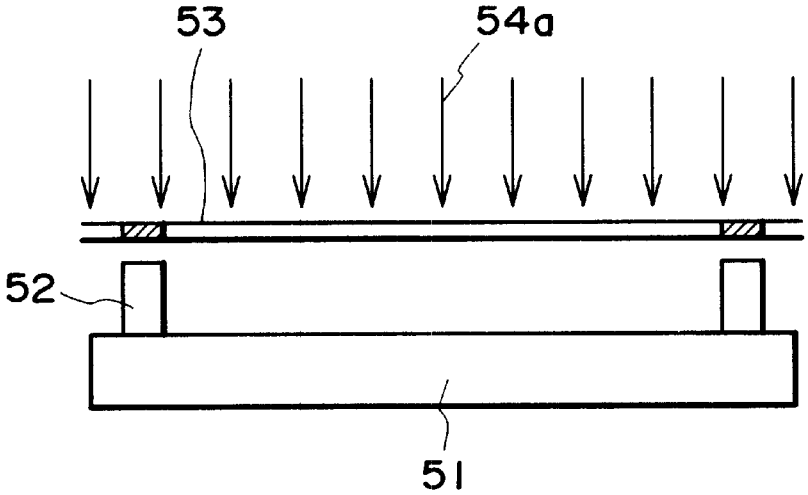
Figure 9C:
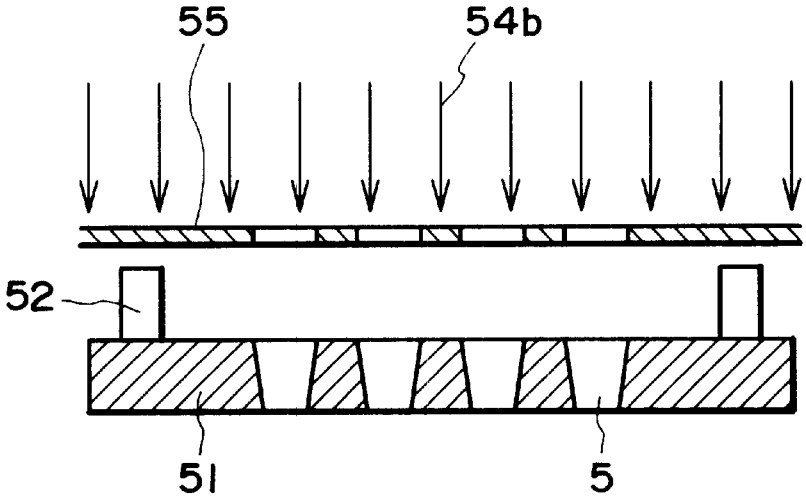

FIGS. 9A to 9C are views which illustrate the method for manufacturing the orifice plate 4 shown in FIG. 3 and FIG. 6. The orifice plate 4 is manufactured through the processing steps illustrated in FIGS. 9A to 9C.

Now, at first, a fluororesin plate 51 is prepared in a thickness of 100 $\mu$m as shown in FIG. 9A. Then, in FIG. 9B, the radiated beams of synchrotron 54*a* are irradiated to the surface of the fluororesin plate 51, as the high luminance X-rays, through the mask 53 which has been patternediin advance in order to form extrusions 52 of 50 $\mu$m high each on the surface of the fluororesin plate 51.

Then, in FIG. 9C, the radiated beams of the synchrotron 54*b* are irradiated to the surface of the fluororesin plate 51 through the mask 55 having the apertures on the portions corresponding to the discharge ports 5 to form the tapered discharge ports 5, respectively. The radiated beams of the synchrotron 54*a* and 54*b* are radiated along the optical axes of the electron accumulated on the sysncrotron. Here, in order to taper the sectional configuration of each of discharge ports 5, only the circumferential portions of the apertures of the mask 55 are made thinner than the thickness of the light shielding portion of the mask 55 with the exception of such circumferential portions. Also, a copper plate is used for the masks 53 and 55 used here, but the invention is not necessarily limited to the use of the copper plate. It should be good enough if the plate is capable of shielding the radiated beams of the synchrotron.

As described above, with the etching process using the radiated beams of the synchrotron, the extrusions 52 and the discharge ports 5 are formed on the orifice plate 4, while the masks 53 and 55 are produced by photolithographing process for use of the radiated beams of synchrotron. Therefore, the extrusions 52 and the discharge ports 5 are formed in high precision and high density. Also, since the radiated beams of the synchrotron are used for the formation of the discharge ports 5, it becomes possible to form them in high aspect ratio. As a result, a highly precise process is possible in high density for the material whose thickness is large enough for easier handling, which presents a significant advantage.

Also, the extrusions 52 and the discharge ports 5 are formed on the orifice plate before it is bonded to the front end of the elemental substrate 1 and the ceiling plate 3. Therefore, there is no possibility that dust particles may enter the interior of nozzles of the liquid discharge head as in the conventional liquid discharge head where the discharge ports are formed after the orifice plate is bonded to the front end of the elemental substrate and the ceiling plate.

Figure 10A:
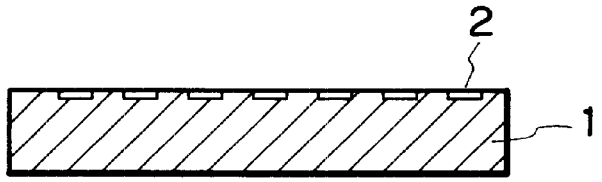
FIGS. 10A, 10B, 10C and 10D are views which illustrate the method for manufacturing the liquid discharge head described in conjunction with FIG. 3 and FIG. 6.
Figure 10B:
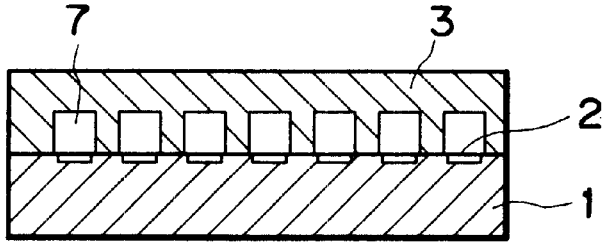
Figure 10C:
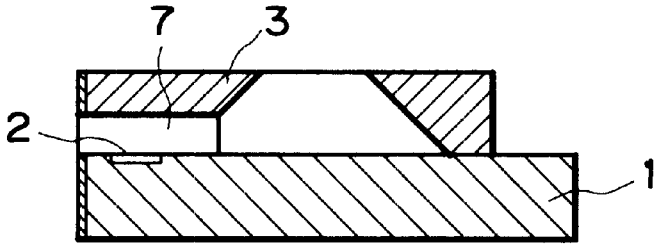
Figure 10D:
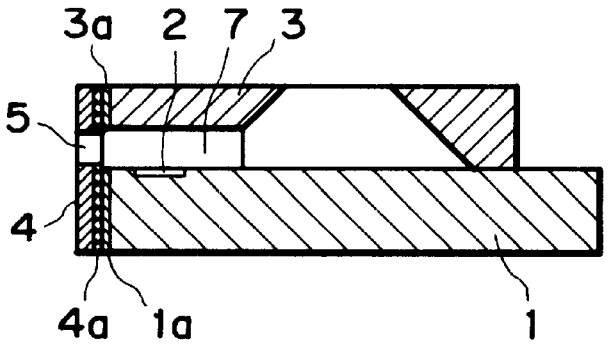

FIGS. 10A to 10D are views which illustrate the method for manufacturing the liquid discharge head described in conjunction with FIG. 3 and FIG. 6. In accordance with the present embodiment, the liquid discharge head is manufactured through the processing steps shown in FIGS. 10A to 10D. FIGS. 10A and 10B are sectional views taken in the direction perpendicular to the flow path direction of the liquid flow path 7 shown in FIG. 3. FIGS. 10C and 10D are sectional views taken in the flow path direction of the liquid flow path 7.

At first, in FIG. 10A, using the lithography patterning is performed on the portion of the silicon on the surface of the elemental substrate 1 on the heat generating device 2 side, which is bonded to the ceiling plate 3.

Then, as shown in FIGS. 10B and 10C, the Ar gas or the like is irradiated to the bonding surface of the elemental substrate 1 to the ceiling plate 3, and the bonding surface of the ceiling plate 3 to the elemental substrate 1 as well, to activate these bonding surfaces. After that, using a cold bonding apparatus these bonding surfaces of the elemental substrate 1 and the ceiling plate 3 are bonded themselves together in the room temperature In this manner, a head substrate is produced with a plurality of heat generating devices and liquid flow paths 7 arranged on it.

The cold bonding apparatus used here comprises two chambers, a preliminary chamber and a pressure chamber, and the degree of applied vacuum is 1 to 10 Pa for each of them. In the preliminary chamber of the cold bonding apparatus, the bonding surfaces of the elemental substrate 1 and the ceiling plate 3 are positioned. Here, the aligned positions of the elemental substrate 1 and the ceiling plate 3 are conditioned to be in agreement by means of image processing. After that, the elemental substrate 1 and the ceiling plate 3 are carried to the pressure chamber, while keeping them in the aligned positions. In the pressure chamber, energy particles are irradiated to the bonding surfaces of the elemental substrate 1 and the ceiling plate 3 by use of the high-speed atomic beam of saddle field type. After the bonding surfaces of the elemental substrate 1 and the ceiling plate 3 are activated by the irradiation of the energy particles, the elemental substrate 1 and the ceiling plate 3 are bonded together. At this juncture, the elemental substrate 1 and the ceiling plate 3 are heated at a temperature of 200° C. or less or pressurized in order to reinforced the bonding portions of the elemental substrate 1 and the ceiling plate 3.

As the method for bonding the elemental substrate 1 and the ceiling plate 3, each of the bonding surfaces is activated before the surfaces are bonded. In place of such method, it may be possible to bond the elemental substrate 1 and the ceiling plate 3 through the epoxy resin or water glass serving as bonding agent.

Then, in FIG. 10D, the orifice plate 4 is bonded to the front end of the head substrate formed by the elemental substrate 1 and the ceiling plate 3 thus bonded together. Before the orifice plate 4 is bonded, the recessed portions (not shown) that fit with the extrusions 52 of the orifice plate 4, which has been described in conjunction with FIGS. 9A to 9C, are formed on the front end of the head substrate. Here, the extrusions 52 are fitted into such holes to position the orifice plate 4. For example, it may be possible to form dummy liquid flow paths, which are different from the liquid flow paths for the actual use of liquid discharges, as such recessed portions for fitting the extrusions 52. In this manner, it becomes possible to position the orifice plate 4 and the head substrate by use of a simple device without using a complicated liquid discharge recording apparatus for image processing or the like if only the recessed portions, which are formed on the bonding surface of the head substrate comprising the elemental substrate 1 and the ceiling plate 3 to face the orifice plate 4, are fitted with the extrusions 52 of the orifice plate 4 to position them.

When the orifice plate 4 is bonded to the front end of the elemental substrate 1 and the ceiling plate 3, the water coating that contains fluororesin is applied the front end of the elemental substrate 1 and the ceiling plate 3. After that, the front end thereof is given a plasmic treatment. Then, the front end thus treated is immersed in the water solution of methacrylic acid (MAA), acrylic acid (AA), and methacrylic acid-2-(dimethylamino) ethyl (DMAEMA) monomer at a temperature of 60° C., and at the same time, the ultraviolet rays are irradiated to the front end thereof, thus executing the surface treatment at 1*a* and 3*a* in FIG. 10D. In accordance with the present embodiment, the water coating that contains fluororesin is applied to the front end of the elemental substrate 1 and the ceiling plate 3. However, in place of applying the water coating that contains fluororesin, it may be possible to transfer fluororesin to the front end of the elemental substrate 1 and the ceiling plate 3.

The surface of the orifice plate which is bonded to the front end of; the elemental substrate 1 and the ceiling plate 3 is also given the plasmic treatment. Then, it is immersed in the monomer water solution, and at the same time, the bonding surface thereof is irradiated by the ultraviolet rays for the execution of surface treatment at 4*a* in FIG. 10D.

After that, as shown in FIG. 10D, the head substrate formed by bonding the elemental substrate 1 and the ceiling plate 3, and the orifice plate 4 are heated at a temperature of 150° C., and then, the orifice plate 4 is bonded to the front end of the elemental substrate 1 and the ceiling plate 3 under pressure. In this case, the method for bonding the orifice plate 4 utilizes the self-bonding properties without using any bonding agent. The self-bonding properties means such ones that the molecular chains of two substances are diffused each other to bond them together, and the strong bond is formed on each of such bonded portions to prevent the two substances once bonded to be separated. Then, the self-bonding means that two polymeric materials are bonded together by the macro-Brownian motion and diffusion of polymer molecules between the same two polymeric materials. Therefore, the water coating that contains fluororesin, which is applied to the elemental substance 1 and the ceiling plate 3, and the bonding surface of the orifice plate 4 are resin moisten, respectively, and then, each of the graft polymerized bonding surfaces is heated and bonded together under pressure so as to keep them in contact with each other sufficiently. Thus, the elemental substrate 1 and the ceiling plate 3, and the orifice plate 4 formed by fluororesin are bonded together firmly.

As described above, even when the fluororesin having the ink repellency is used as the material of the orifice plate 4, it is possible to bond the orifice plate 4 by itself to the circumferential portion of the liquid flow paths reliably on the front end of the elemental substrate 1 and the ceiling plate 3, hence obtaining the sufficient bonding strength of the orifice plate 4.

Also, as another method for bonding the orifice plate 4 to the front end of the elemental substrate 1 and the ceiling plate 3, it may be possible to adopt the surface active bonding (SAB) method that utilizes the self-bonding of the elemental substrate 1 and the ceiling plate 3 to the orifice plate 4 as described earlier.

Using the cold bonding apparatus described above the front end of the elemental substrate 1 and the ceiling plate 3 are aligned in a vacuum with reference to the bonding surface of the orifice plate. After that, the Ar particles are directed to both of the bonding surfaces to activate each of them. Then, subsequent to having performed the surface treatments each at 1*a,* 3*a,* and 4*a* in FIG. 10D, both of them are bonded together. In this case, the bonding is possible without the application of the fluororesin coating to the front end of the elemental substrate 1 and the ceiling plate 3. In this respect, the surface active bonding may be implemented by the irradiation of argon (Ar) high-speed atomic beams or the irradiation of hydrogen or oxygen radical beams. Here, also, the neutralized beams are adopted as the ion beam irradiation. This is because the IC devices, which are incorporated in the heater board, should be prevented from any destruction.

(Other Embodiments)

FIGS. 11A to 11D are views which illustrate the method for manufacturing the orifice plate 4 represented in FIG. 3 and FIG. 6. The orifice plate 4 is manufactured through the processing steps shown in FIGS. 11A to 11D.

Figure 11A:
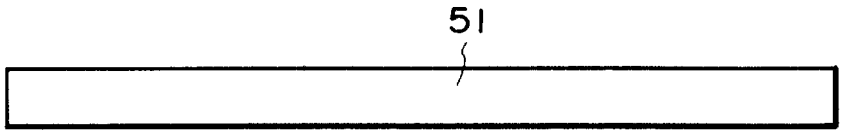
FIGS. 11A, 11B, 11C and 11D are views which illustrate the manufacturing method of the orifice plate represented in FIG. 3 and FIG. 6.

At first, in FIG. 11A, the fluororesin plate 51 of 30 $\mu$m thick is prepared as the plate member having the ink repellency. Then, the surface of the fluororesin plate 51 is immersed in the mixture of sodium hydroxide water solution and ammonia water solution to replace the fluorine atom on the surface layer of the fluororesin plate 51 with the natrium atom, the oxygen atom, or the like. In this way, the surface layer of the fluororesin plate 51 is arranged to be the conductive layer. With this reforming process, the surface layer of the fluororesin plate 51 is provided with conductivity.

Figure 11B:
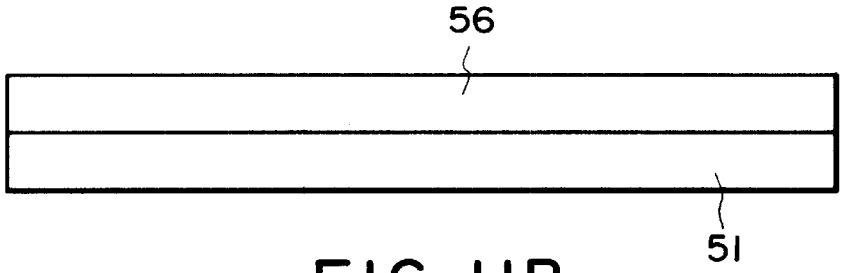

Then, in FIG. 11B, the conductive layer of the fluororesin plate 51 is made the cathode. Then, using the Ni plating bath having nickel sulfate, nickel chloride and bori acid the Ni electric plating is performed-at a temperature of 50° C. thereof with the cathode having the current density of 5 A/cm$^2$. With this plating method, the metal plated layer 52 is formed on the surface of the fluororesin plate 51. The metal plated layer 52 is not necessarily formed by means of the plating bath, but it may be possible to form this layer with a metal extracted from various kinds of metallic salt, such as monosalt, double salt, complex salt. The metal that forms the metal plated layer 5 is a single metal, such as Ni, Au, Pd, Pt, Cr, Cu, Ag, Zn, or an alloy of Cu—Zn, Sn—Co, Ni—Fe, Ni—Cr, Ni—Pd, Ni—Co, Zn—Ni, among some others. The material which makes some other electric plating possible may also be adoptable for the metal plated layer 52.

Figure 11C:
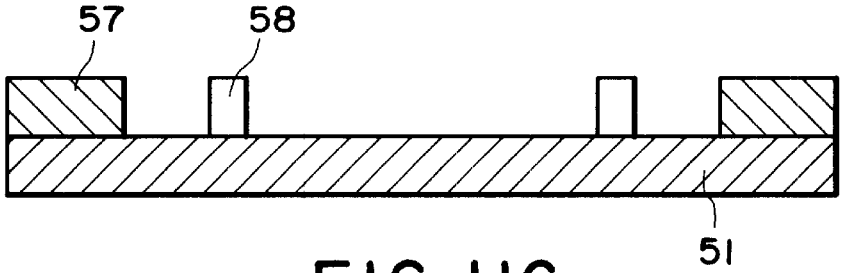

Then, in FIG. 11C, the metal plated layer 52 is patterned by the photolithographic process and etching to remove the specific portions, thus forming the reinforcement member 57 and the extrusions 58 on the surface of the fluororesin plate 51. Each of the reinforcement member 57 and the extrusions 58 is formed by the remaining portion of the metal plated layer 52 on the fluororesin plate 51.

Figure 11D:
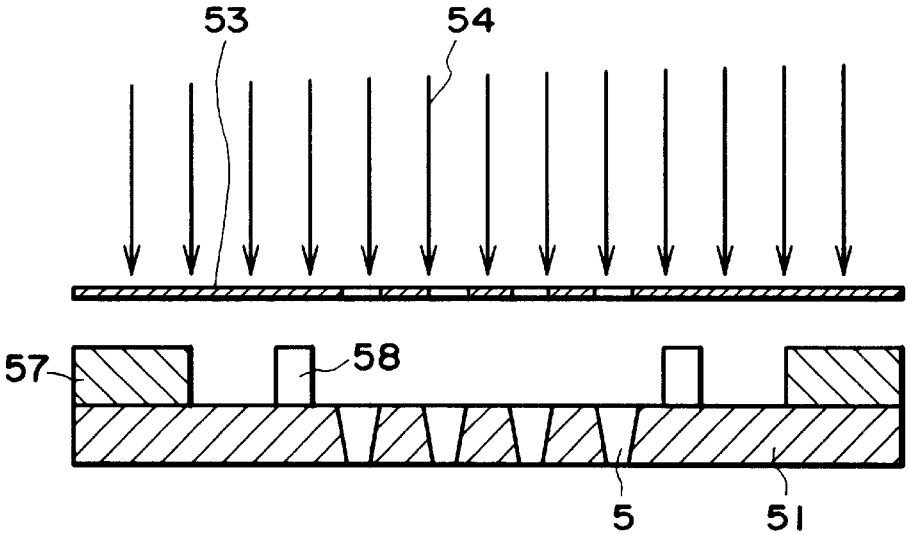

Then, in FIG. 11D, the radiated beams of the synchrotron 54 are irradiated to the surface of the fluororesin plate 51 through the mask 53 having the apertures on the portions corresponding to the discharge ports 5 to form the tapered discharge ports 5, respectively. Thus, the orifice plate 4 is manufactured. The radiated beams of the synchrotron 54 are radiated along the optical axes of the electron accumulated on the syncrotron. Here, in order to taper the sectional configuration of each of discharge ports 5, only the circumferential portions of the apertures of the mask 53 are made thinner than the thickness of the light shielding portion of the mask 53 with the exception of such circumferential portions. Also, a copper plate is used for the mask 53 used here, but the invention is not necessarily limited to the use of the copper plate. It should be good enough if the plate is capable of shielding the radiated beams of the synchrotron.

As described above, with the etching process using the radiated beams of the synchrotron, the discharge ports 5 are formed on the orifice plate 4, while the mask 53 is produced by photolithographing process for use of the radiated beams of synchrotron. Therefore, the discharge ports 5 are formed in high precision and high density. Also, since the radiated beams of the synchrotron are used for the formation of the discharge ports 5, it becomes possible to form them in high aspect ratio. As a result, a highly precise process is possible in high density for the material whose thickness is large enough for easier handling, which presents a significant advantage.

Figure 12A:
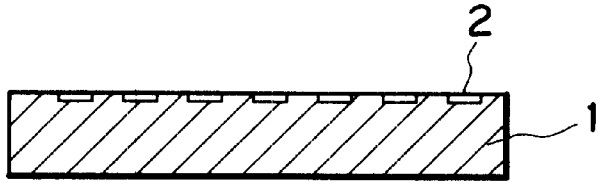
FIGS. 12A, 12B, 12C and 12D are views which illustrate the method for manufacturing the liquid discharge head described in conjunction with FIG. 3 and FIG. 6.
Figure 12B:
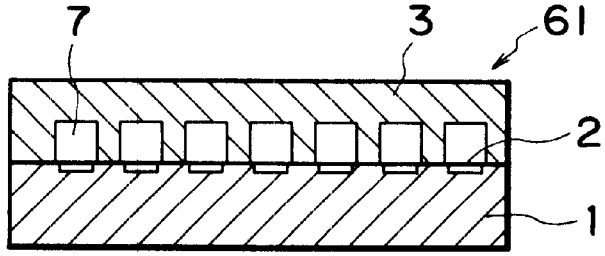
Figure 12C:
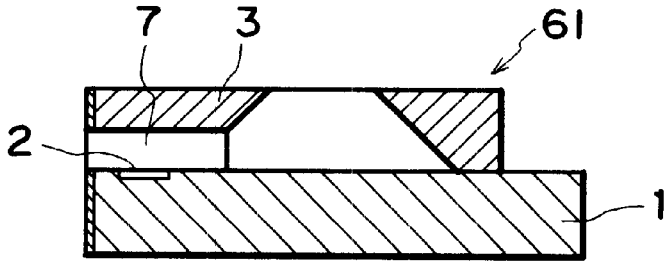
Figure 12D:
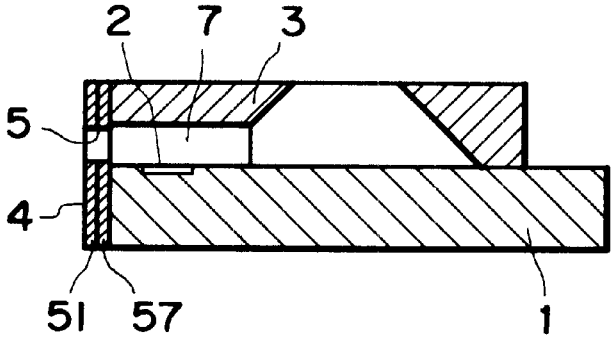

FIGS. 12A to 12D are views which illustrate the method for manufacturing the liquid discharge head described in conjunction with FIG. 3 and FIG. 6. In accordance with the present embodiment, the liquid discharge head is manufactured through the processing steps shown in FIGS. 12A to 12D. FIGS. 12A and 12B are sectional views taken in the direction perpendicular to the flow path direction of the liquid flow path 7 shown in FIG. 3. FIGS. 12C and 12D are sectional views taken in the flow path direction of the liquid flow path 7.

At first, in FIG. 12A, using the lithography patterning is performed on the portion of the silicon on the surface of the elemental substrate 1 on the heat generating device 2 side, which is bonded to the ceiling plate 3.

Then, as shown in FIGS. 12B and 12C, the Ar gas or the like is irradiated to the bonding surface of the elemental substrate 1 to the ceiling plate 3, and the bonding surface of the ceiling plate 3 to the elemental substrate 1 as well, to activate these bonding surfaces. After that, using a cold bonding apparatus these bonding surfaces of the elemental substrate 1 and the ceiling plate 3 are bonded themselves together in the room temperature. In this manner, a head substrate 61 is produced with a plurality of heat generating devices and liquid flow paths 7 arranged on it.

The cold bonding apparatus used here comprises two chambers, a preliminary chamber and a pressure chamber, and the degree of applied vacuum is 1 to 10 Pa for each of them. In the preliminary chamber of the cold bonding apparatus, the bonding surfaces of the elemental substrate 1 and the ceiling plate 3 are positioned. Here, the aligned positions of the elemental substrate 1 and the ceiling plate 3 are conditioned to be in agreement by means of image processing. After that, the elemental substrate 1 and the ceiling plate 3 are carried to the pressure chamber, while keeping them in the aligned positions. In the pressure chamber, energy particles are irradiated to the bonding surfaces of the elemental substrate 1 and the ceiling plate 3 by use of the high-speed atomic beam of saddle field type. After the bonding surfaces of the elemental substrate 1 and the ceiling plate 3 are activated by the irradiation of the energy particles, the elemental substrate 1 and the ceiling plate 3 are bonded together. At this juncture, the elemental substrate 1 and the ceiling plate 3 are heated at a temperature of 200° C. or less or pressurized in order to reinforced the bonding portions of the elemental substrate i and the ceiling plate 3.

As the method for bonding the elemental substrate 1 and the ceiling plate 3, each of the bonding surfaces is activated before the surfaces are bonded. In place of such method, it may be possible to bond the elemental substrate 1 and the ceiling plate 3 through the epoxy resin or water glass serving as boding agent.

Then, in FIG. 12D, the orifice plate 4, which is formed by the fluororesin plate 51 and the reinforcement member 51, is bonded to the front end of the head substrate 61 formed by the elemental substrate 1 and the ceiling plate 3 thus producing the liquid discharge head.

Figure 13A:
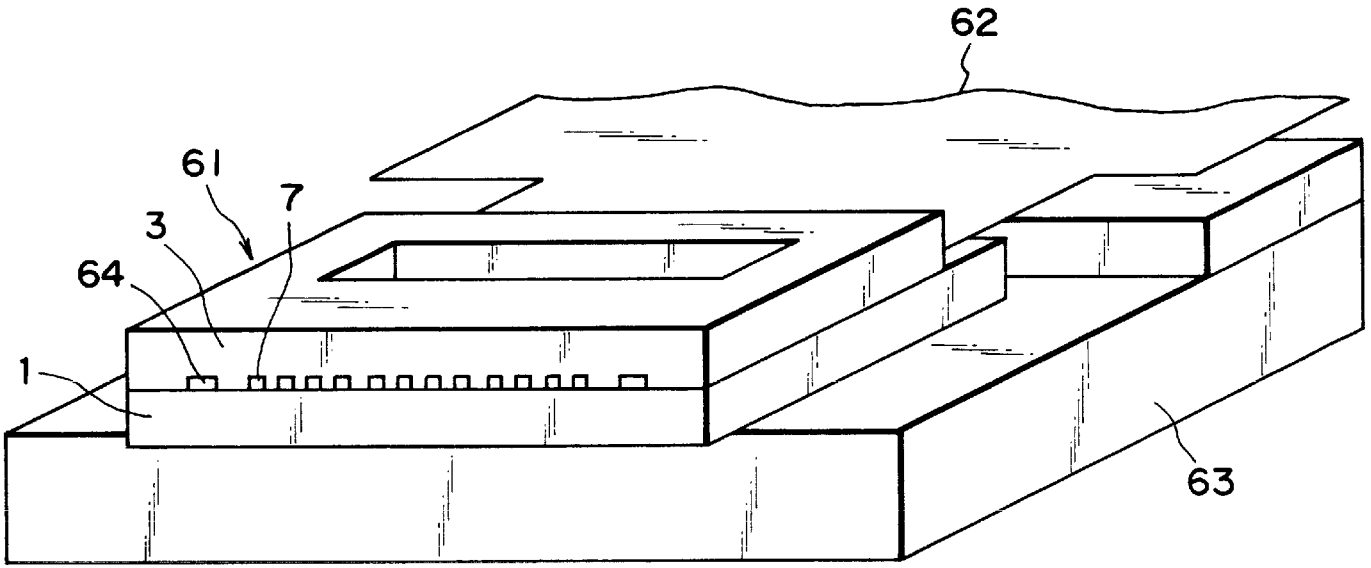
FIGS. 13A and 13B are views which illustrate the method for bonding the orifice plate to the head substrate described in conjunction with FIG. 3 and FIG. 6.
Figure 13B:
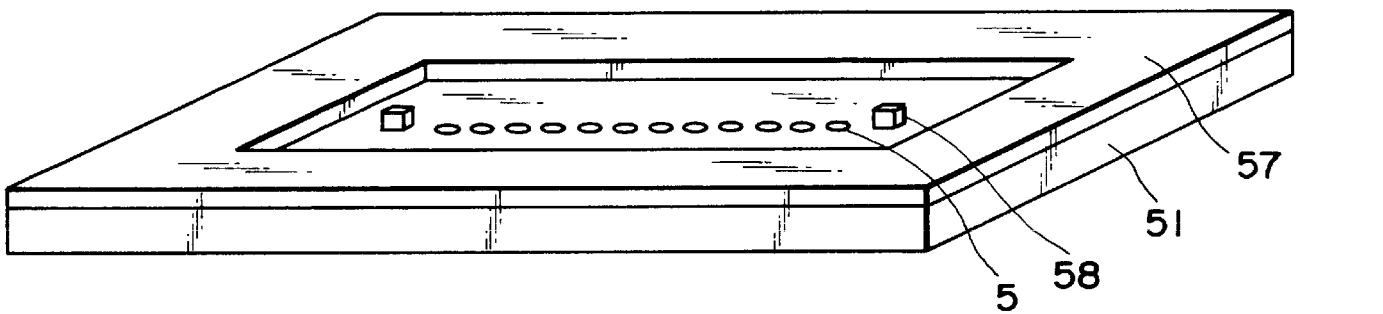

FIGS. 13A and 13B are views which illustrate the method for bonding the orifice plate to the front end of the head substrate 61. FIG. 13A is a perspective view which shows the liquid discharge head before the orifice plate is bonded to the head substrate. FIG. 13B is a perspective view which shows the orifice plate.

As shown in FIG. 13A, the head substrate 61, which if formed by the elemental substrate 1 and the ceiling plate 3, is fixed to the base plate 63. With the side of the head substrate 61, which is opposite to the liquid flow paths 7, the TAB tape 62 is connected. On the front end of the head substrate 61 on the liquid flow path 7 side, the recessed portion 64 is formed to fit with the extrusion 58 of the orifice plate 4 which is described in conjunction with FIG. 11C. The recessed portion 64 is a dummy nozzle formed together with the liquid flow paths 7.

When the orifice plate 4 is bonded to the head substrate 61, the extrusion 58 is inserted into the recessed portion 64 to position the orifice plate 4. At this juncture, the epoxy resin bonding agent is applied to the bonding surface of the head substrate 61 and the base plate 63 in a thickness of approximately 2 $\mu$m. Then, the bonding portion of the head substrate 61 to the orifice plate 4 is heated at a temperature of 150° C. Then, the head substrate 61 and the orifice plate 4 is bonded under pressure.

As described above, the reinforcement member 57 is formed on the fluororesin plate 51 to reinforced it. Thus, the strength of the fluororesin plate 51 is made higher. In this way when the orifice plate 4 is given heat treatment or the like at a high temperature on the front end of the head substrate 61 for bonding, the deformation of the fluororesin plate 51 due to heating is prevented by the reinforcement member 57 thus provided. As a result, it becomes possible to prevent the discharge ports 5 from being deformed. The orifice plate 4 is reliably bonded to the head substrate 61 without spoiling the discharge characteristics of the head. Also, it is possible to obtain a highly reliable liquid discharge head which can cope sufficiently with the changes of environment caused by heat or the like. Further, since the discharge ports 5 are formed on the fluororesin plate 51 having the ink repellency, the discharge direction of ink discharged from the discharge ports 5 is stabilized, hence obtaining a liquid discharge head having the stabilized characteristics of discharges. Then, since the orifice plate 4 is formed by the fluororesin plate 51 and the reinforcement member 57, it is possible for the orifice plate 4 to maintain good ink repellency for a long time.

Also, with the formation of the metal plated layer on the fluororesin plate 51 by the application of the plating method, which becomes the reinforcement member 57, it becomes easier to hand the fluororesin plate 51, among some other advantages. Also, the temperature proof property of the orifice plate 4 is enhanced again the heat treatment to be given. Further, it becomes possible to manufacture the orifice plate 4 with the formation of the reinforcement member 57 on the fluororesin plate 51 by the adoption of a simple apparatus.

Moreover, when the head substrate 61 and the orifice plate 4 are bonded together, the head substrate 61 and the orifice plate 4 are positioned by fitting the extrusion 58 formed on the orifice plate 4 with the recessed portion 64 provided for the head substrate 61. There is no need for the application of image process or use of any complicated apparatus. With a simple apparatus, the positioning is possible.

Figure 14B:
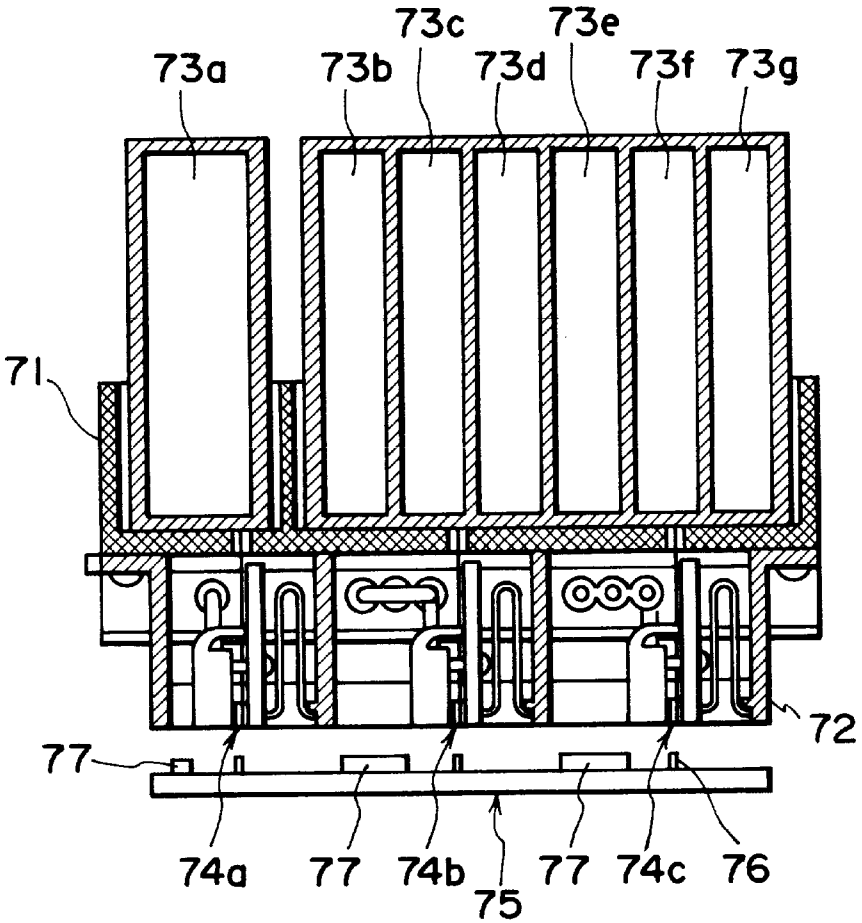
FIGS. 14A and 14B are views which illustrate the recording head unit on which a plurality of liquid discharge heads shown in FIG. 3 are mounted.
Figure 14A:
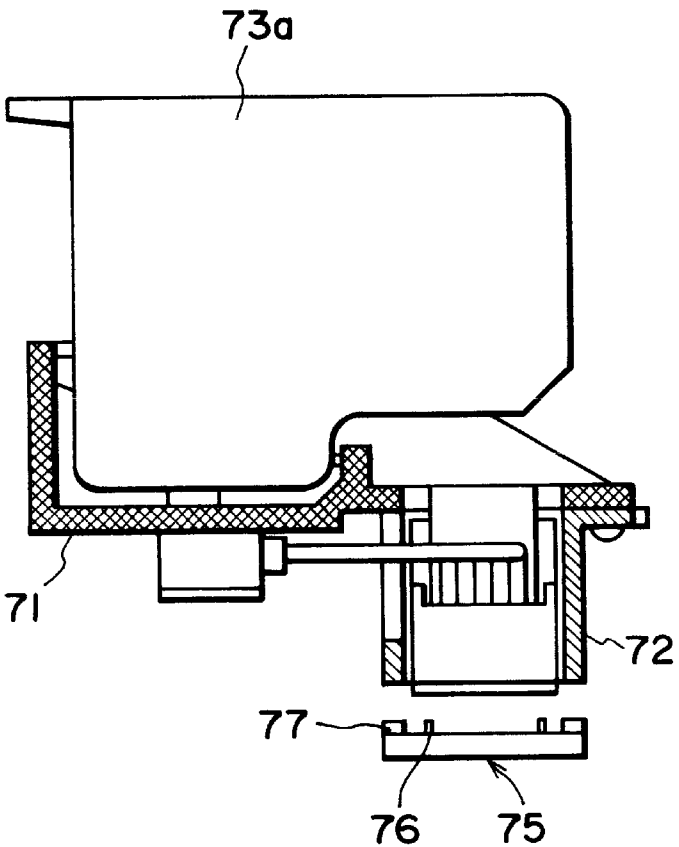
Figure 15:
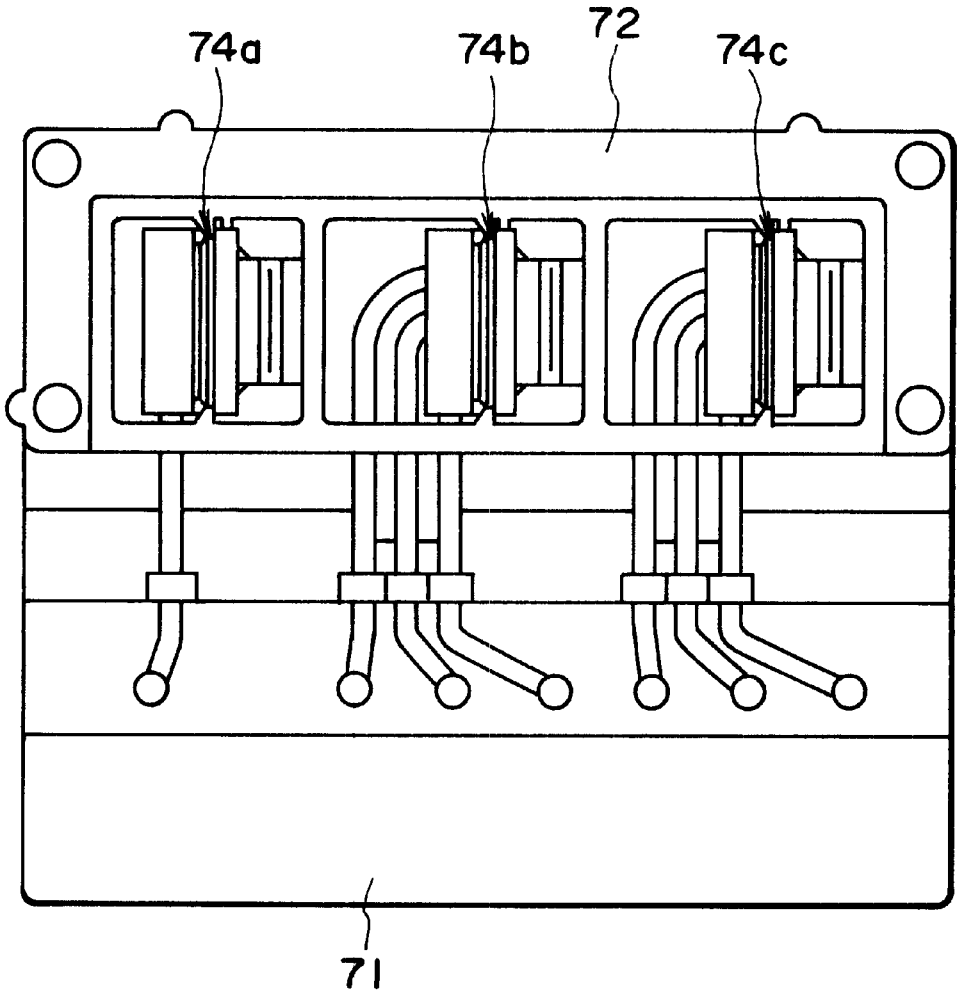
FIG. 15 is a view which shows the recording head unit in the state that the orifice plate is removed from the recording head unit represented in FIGS. 14A and 14B, observed from the bonding side of the orifice plate.

FIGS. 14A and 14B are views which illustrate the recording head unit on which a plurality of liquid discharge heads are mounted. FIG. 14A is a sectional view taken in the direction perpendicular to the arrangement direction of the plural liquid discharge heads. FIG. 14B is a cross-sectional view taken in the arrangement direction of the plural liquid discharge heads. FIG. 15 is a view which shows the recording head unit in the state where the orifice plate is removed from the recording head unit represented in FIGS. 14A and 14B, observed from the portion where the orifice plate is bonded.

As shown in FIGS. 14A and 14B, there is fixed a frame member 72, on which three liquid discharge heads are mounted, to the head holder 71 to which the plural ink tanks are detachably attachable. For the head holder 71, there are arranged an ink tank 73*a* for use of black color; an ink tank 73*b* for use dark yellow color; an ink tank 73*c* for use of dark magenta color; an ink tank 73*d* for use of dark cyan color; an ink tank 73*e* for use of light yellow color; an ink tank 73*f* for use of light magenta color; an ink tank 73*g* for use of light cyan color, respectively. Then, three liquid discharge heads which can discharge each ink are mounted on the frame 72. The recording head unit is arranged to establish the positional relationship reliably between these three liquid discharge heads with each other.

As shown in FIG. 15, the head substrates 74*a,* 74*b,* and 74*c* that constitute each of the liquid discharge heads, respectively, are installed in the interior of the frame 72. Each of the head substrates 74*a,* 74*b,* and 74*c* is the same as the head substrate 61 which is described above. Then, the orifice plate 75 is bonded to each of them to form three liquid discharge heads. There are formed the plural extrusions 76 for positioning use, and the reinforcement member 77 on the surface of the orifice plate 75 on the head substrate side. The extrusions 76 and the reinforcement member 77 are formed by the same method as the one for manufacturing the orifice plate described in conjunction with FIGS. 11A to 11D. Also, on each of the head substrates, 74*a,* 74*b,* and 74*c,* the recessed portion, such as the one shown in FIG. 13A, is formed, respectively, for positioning each of them and the orifice plate 75. When each of the extrusions 76 is fitted into each of the recessed portions correspondingly, the position of each of the head substrates 74*a,* 74*b,* and 74*c* is fixed. Here, since the orifice plate 75 is reinforced by use of the reinforcement member 77, it becomes possible to prevent the orifice plate 75 from being deformed even if the orifice plate 75 is heated at a high temperature for bonding the orifice plate 75 to the head substrates 74*a,* 74*b,* and 74*c.*

After the orifice plate 75 is bonded to each of the head substrates 74*a,* 74*b,* and 74*c* which has been positioned, respectively, the orifice plate 74 is bonded to the frame 72 by the application of bonding agent or the like. In this way, the liquid discharge heads formed by the head substrates 74*a,* 74*b,* and 74*c* bonded to the orifice plate 75, and frame 72 are reinforced.

In this respect, as the structural material of the orifice plate that constitutes the heads, it may be possible to use a material having the mode in which fluorine is diffused in a resin usable for the orifice plate besides the fluororesin described above. Also, besides them, it is of course possible to contain or diffuse some other material in order to enhance the function and performance as the material of the orifice plate.

Particularly when the bonding is made by the utilization of the self-bond, it is preferable to select the material having the high-temperature property, such as a heat resistance of 200° C. or more.

Figure 16:
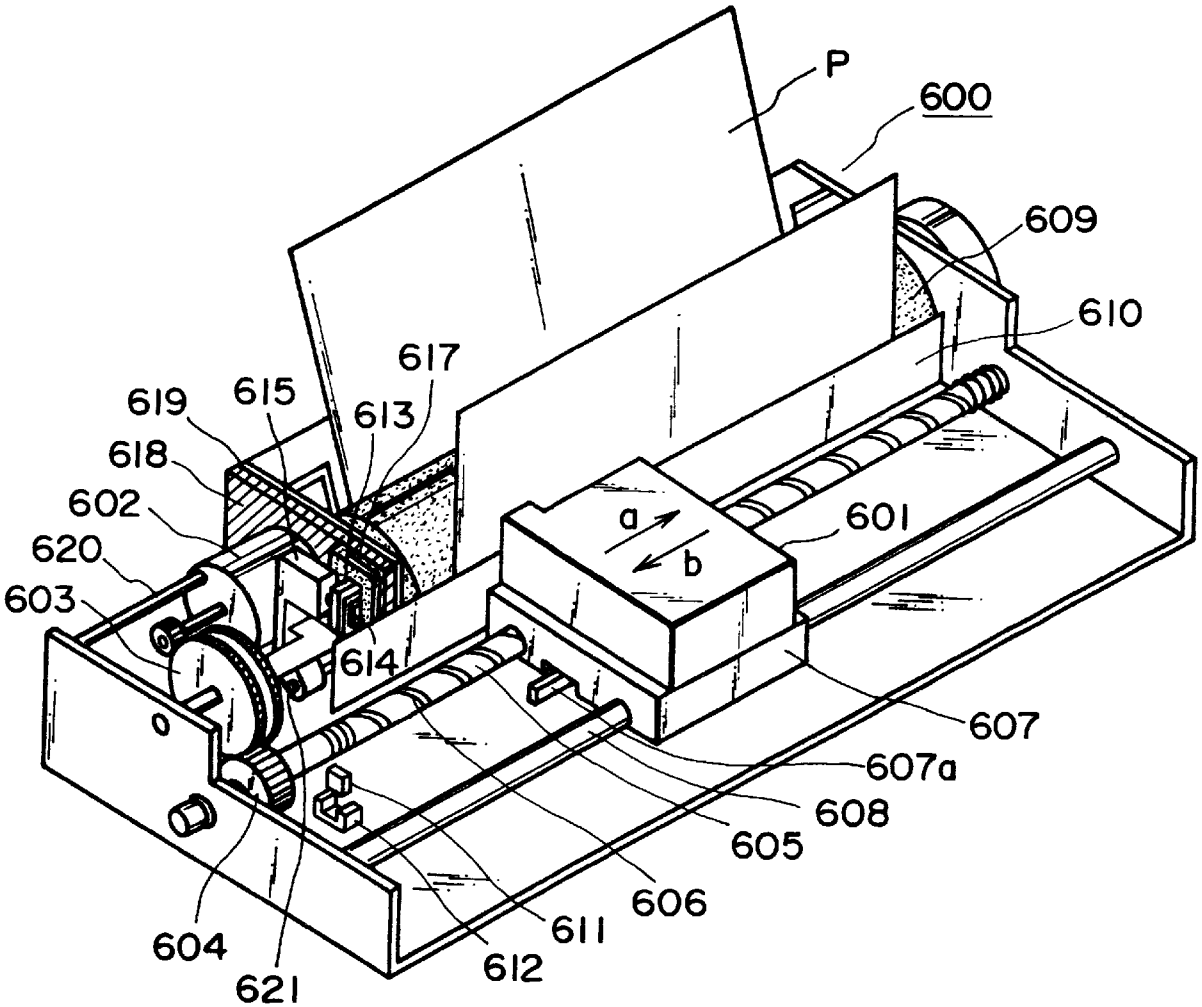
FIG. 16 is a perspective view which shows one example of the ink jet recording apparatus serving as the liquid discharge recording apparatus having the liquid discharge head illustrated in FIG. 3 and FIG. 6 mounted on it.

FIG. 16 is a perspective view showing an ink jet recording apparatus which is one example of the liquid discharge recording apparatus having on it the liquid discharge head described in conjunction with FIG. 3 and FIG. 6. The head cartridge 601 mounted on the ink jet recording apparatus 600 shown in FIG. 16 is provided with the liquid discharge head described in conjunction with FIG. 3 and FIG. 6, and the liquid container that holds liquid to be applied to the liquid discharge head. As shown in FIG. 16, the head cartridge 601 is mounted on the carriage 607 which engages with the spiral groove 606 of the lead screw 605 that rotates through the power transmission gears 603 and 604 interlocked with the regular and reverse rotations of the driving motor 602. By the driving power of the driving motor 602, the head cartridge 601 reciprocates together with the carriage 607 along the guide 608 in the directions indicated by arrows a and b. The ink jet recording apparatus 600 is provided with a recording medium supply device (not shown) that carries the printing sheet P serving as the recording medium that receives ink or other liquid discharged from the head cartridge 601. The sheet pressure plate 610 for use of the printing sheet P carried on the platen 609 by use of the recording medium supply device is arranged to press the printing sheet P to the platen 609 over the traveling direction of the carriage 607.

In the vicinity of one end of the lead screw 605, the photocouplers 611 and 612 are arranged. The photocouplers 611 and 612 constitute home position detecting means that recognizes the presence of the lever 607*a* of the carriage 607 within the region covered by the photocouplers 611 and 612 in order to switch over the rotational directions of the driving motor 602, among some other operations. In the vicinity of the one end of the platen 609, the supporting member 613 is arranged to support the cap member 614 that covers the front end where the discharge ports are provided for the head cartridge 601. Also, ink suction means 615 is provided for sucking ink residing in the interior of the cap member 61 due to idle discharges or the like from the head cartridge 601. With this ink suction means 615, the suction recovery of the head cartridge 601 is performed through the aperture of the cap member 614.

For the ink jet recording apparatus 600, the main body supporting member 619 is provided. For this main body supporting member 619, the traveling member 618 is supported movably in the forward and backward directions, that is, supported movably in the direction at right angles to the traveling directions of the carriage 607. On the traveling member 618, a cleaning blade 617 is mounted. The cleaning blade 617 is not necessarily limited to this mode. The cleaning blade in some other known mode may be adoptable. Further, a lever 620 is provided for initiating suction when operating a suction recover by use of the ink suction means 615. The lever 620 moves along the movement of the cam 621 which engages with the carriage 607. The movement thereof is controlled by known transmission means, such as a clutch, that switches over the driving power of the driving motor 602. The ink jet recording controlling unit (not shown in FIG. 16) is installed on the main body of the ink jet recording apparatus to supply signals to the heat generating devices arranged for the head cartridge 601 or execute the driving controls of each of the mechanisms described above.

The ink jet recording apparatus 600 thus structured performs recording on a printing sheet P, which is carried on the platen 609 by means of the recording medium supply device described earlier, while the head cartridge 601 reciprocates on the entire width of the printing sheet P.

As described above, in accordance with the present embodiment, the bonding force is secured between the orifice plate 4 and the head substrate of the liquid discharge head with the orifice plate 4 which is bonded to the head substrate by the self-bond thereof even if the fluororesin having ink repellency is used as the material of the orifice plate 4 in order to stabilize the ink discharge direction. Also, the orifice plate 4 is made capable of maintaining a good ink repellency for a long time. Moreover, it is made possible to bond the circumferential portion of the liquid flow paths 7 reliably on the bonding surface of the elemental substrate 1 and the ceiling plate 3 to the orifice plate 4. In this way, the orifice plate 4 is bonded to the end surface of the elemental substrate 1 and the ceiling plate 3 by the self-bond thereof, hence reducing the influence that may be exerted by the thermal expansion of each of the structural parts of the liquid discharge ahead due to the heat generated by the heat generating devices 2 when driving the liquid discharge head. As a result, it becomes possible to obtain the liquid discharge head whose discharge characteristics are stable.

Also, the ink jet recording apparatus 600 is made capable of performing its recording stably on a recording medium against temperature changes, because the apparatus is provided with the liquid discharge head having the stabilized discharge characteristics as described above.

Here, also, as described above, in accordance with the present invention, fluororesin or the like is used as the material of the orifice plate in order to stabilize the liquid discharge direction. Then, the orifice plate having ink repellency is bonded to the head substrate by the self-bond thereof. In this way, it becomes possible to obtain the sufficient bonding strength between the head substrate and the orifice plate. At the same time, the orifice plate is made capable of maintaining a good ink repellency for a long time, hence producing a significant effect that the discharge characteristics of the liquid discharge head becomes stabilized, and that the liquid discharge head thus obtained is made capable of coping with the environmental changes due to heat or the like.

Also, as described above, in accordance with the present invention, the orifice plate has ink repellency, and at the same time, it is formed with the reinforcement member provided for the plate member having the discharge ports on it. Therefore, the deformation of the plate member that may be caused by heat is prevented by such reinforcement member when the orifice plate is bonded to the head substrate with the high-temperature process. As a result, there is a significant effect that the orifice plate is bonded to the head substrate assuredly, and that it is made possible to obtain a highly reliable liquid discharge head which can sufficiently cope with the environmental changes due to heat or the like. Also, with the plate member having ink repellency which serves as the orifice plate, the discharge direction is stabilized for the ink discharged from the discharge ports formed on such plate member. As a result, it becomes possible to obtain the liquid discharge head which is provided with the orifice plate that can maintain a good ink repellency for a long time.

Also, with the formation of the metal plated layer on the plate member as the reinforcement member by the application of a plating method, it becomes easier to handle the plate member whose thickness is several tens of $\mu$m, while the heat resistance of the orifice plate is enhanced when heat treatment is given. Also, there is an effect that the orifice plat having the reinforcement member therewith can be manufactured by use of a simple apparatus.

Further, when the orifice plate is bonded to the head substrate, the extrusion formed on the orifice plate is fitted into the recessed portion formed on the bonding surface of the head substrate to the orifice plate for positioning the head substrate and the orifice plate. As a result, there is no need for a complicated apparatus that performs image process or the like for such positioning operation. Then, there is a significant effect that the liquid discharge head can be manufactured by use of a simpler apparatus.

Furthermore, with the formation of the discharge ports on the orifice plate by the etching process using the high-luminance X rays, it is possible to form the discharge ports on the orifice plate in high precision and high density, because the mask adopted for the etching process is produced by the photolithographic process. As a result, there is an effect that it becomes possible to manufacture the liquid discharge head capable of forming highly precise images.

What is claimed is:

1. An ink jet head comprising:

a head substrate provided with a plurality of ink paths and ink discharging means each arranged for each of said paths; and an orifice plate provided with ink discharge openings each communicated with each of said ink paths and bonded to said head substrate, said orifice plate including a water repellent material and a bonding surface wherein said bonding surface is bonded to said head substrate and is modified or treated to be self-bonded to said head substrate.

2. An ink jet head according to claim 1, wherein the bonding surface is modified or treated by a plasma treatment or a laser irradiation.

3. An ink jet head according to claim 1, wherein a bonding surface of said head substrate is modified by a plasma treatment or laser treatment.

4. A method for manufacturing an ink jet head comprising the steps of:

preparing a head substrate provided with a plurality of ink paths and ink discharging means each arranged for each of said paths;

preparing an orifice plate provided with ink discharge openings communicated with each of said ink paths and bonded to said head substrate, said orifice plate comprising a water-repellent material and having a bonding surface side for bonding to said head substrate;

performing a surface treatment or modification on the bonding surface side of said orifice plate; and self-bonding said orifice plate to said head substrate.

5. A method for manufacturing an ink jet head according to claim 4, wherein the surface treatment is a plasma treatment or a laser irradiation.

6. A method for manufacturing an ink jet head according to claim 4, comprising a step of performing a plasma treatment or a laser treatment to a bonding surface of said head substrate.

7. An ink jet head comprising:

a head substrate having a fluororesin coating on a bonding surface thereof, said head substrate provided with a plurality of ink paths and pressure generating elements each arranged for each of said paths; and an orifice plate including a resin containing fluorine, said orifice plate provided with ink discharge openings each communicated with each of said ink paths, and said orifice plate having a bonding surface, wherein said orifice bonding surface and said head substrate bonding surface are provided at least with a surface treatment, wherein the surface treatment is a plasma treatment to self-bond said orifice plate and said substrate.

8. An ink jet head comprising:

a head substrate provided with a plurality of ink paths and pressure generating elements each arranged for each of said paths; and an orifice plate including a resin containing fluorine, said orifice plate provided with ink discharge openings each communicated with each of said ink paths, and said orifice plate having a bonding surface, wherein said orifice plate bonding surface and said head substrate bonding surface are provided at least with a laser irradiation surface treatment whereby the bonding surface of said orifice plate to said head substrate is activated and bonded.

9. A method for manufacturing ink jet heads comprising the steps of:

preparing a head substrate having a fluororesin coating on a bonding surface thereof, said head substrate provided with a plurality of ink paths and pressure generating elements each arranged for each of said paths;

preparing an orifice plate including a resin containing fluorine, said orifice plate provided with ink discharge openings communicated with each of said ink paths and bonded to said head substrate;

performing a plasma surface treatment on the bonding surface side of said orifice plate to said substrate and the bonding surface of the head substrate; and self-bonding said orifice plate to said substrate.

10. A method for manufacturing ink jet heads comprising the steps of:

preparing a head substrate provided with a plurality of ink paths and pressure generating elements each arranged for each of said paths;

preparing an orifice plate including a resin containing fluorine, said orifice plate provided with ink discharge openings communicated with each of said ink paths and bonded to said head substrate; and performing a laser irradiation surface treatment on the bonding surface side of said orifice plate to said substrate and on a bonding surface of said head substrate to activate the resin containing fluorine in the bonding surface of said orifice plate; and bonding said orifice plate and said head substrate.

11. A method for manufacturing ink jet heads comprising the steps of:

preparing a head substrate comprising a substrate and a ceiling plate for the substrate, said head substrate provided with a plurality of ink paths and pressure generating elements each arranged for each of said paths;

preparing an orifice plate provided with ink discharge openings communicated with each of said ink paths and bonded to a front end of said head substrate;

immersing the orifice plate, the substrate and the ceiling plate into water containing fluororesin;

plasma treating (i) a front end of the head substrate and (ii) the orifice plate;

irradiating the front end of the head substrate and the orifice plate with UV rays; and bonding the orifice plate, the substrate, and the ceiling plate under pressure.

* * * * *

UNITED STATES PATENT AND TRADEMARK OFFICE

CERTIFICATE OF CORRECTION

PATENT NO. : 6,474,780 B1 
DATED : November 5, 2002
INVENTOR(S) : Masahiko Kubota et al.

It is certified that error appears in the above-identified patent and that said Letters Patent is hereby corrected as shown below:

Title page, Item [54] and Column 1, line 1,
Title: "LIQUID DISCHARGE HEAD" should read -- IMPROVED LIQUID DISCHARGE HEAD, --.

Column 1,
Line 37, "its"should read -- their --.

Column 2,
Line 14, "is" should be deleted;
Line 37, "ies" should read -- ied --; and
Line 57, "pm" should read -- $\mu$m --.

Column 4,
Line 11, "diffused" should read -- diffused into --; and
Line 47, "the each of" should read -- each of the --.

Column 6,
Line 41, "an" should read -- a --; and
Line 50, "due to head" should read -- due to heat --.

Column 7,
Line 34, "abode-described" should read -- above-described --; and
Line 59, "an" should read -- a --.

Column 8,
Line 36, "and" should read -- and at --.

Column 10,
Line 11, "defoaming" should read -- deforming --; and
Line 16, "extends" should read -- extend --.

Column 11,
Line 10, "down stream" should read -- downstream --;
Line 26, "bubbles" should read -- bubble --;
Line 30, "compensate" should read -- compensate for --; and
Line 33, "to" should read -- is allowed to --.

Column 12,
Line 12, "hundreds" should read -- hundred --; and
Line 42, "devices," should read -- device, --.

UNITED STATES PATENT AND TRADEMARK OFFICE

CERTIFICATE OF CORRECTION

PATENT NO. : 6,474,780 B1
DATED : November 5, 2002
INVENTOR(S) : Masahiko Kubota et al.

It is certified that error appears in the above-identified patent and that said Letters Patent is hereby corrected as shown below:

Column 14,
Line 9, “patternediin” should read -- patterned in --;
Line 18, “electron” should read -- electrons --; and
Line 32, “synchroton.” should read -- the synchrotron. --.

Column 15,
Line 4, “temperature” should read -- temperature. --; and
Line 25, “reinforced” should read -- reinforce --.

Column 16,
Line 6, “of;” should read -- of --;
Line 17, “means” should read -- mean --;
Line 18, “that” should read -- in which --; and “diffused” should read -- diffused into --; and
Line 28, “moisten,” should read -- moistened, --.

Column 17,
Line 16, “bori” should read -- boric --;
Line 17, “performed-at” should read -- performed at --;
Line 44, “syncrotron.” should read -- synchrotron. --; and
Line 57, “synchrotron.” should read -- the synchrotron. --.

Column 18,
Line 41, “reinforced” should read -- reinforce --; and
Line 42, “i” should read -- 1 --.

Column 19,
Line 12, “is” should read -- are --;
Line 14, “reinforced” should read -- reinforce --;
Line 40, “again” should read -- again by --.

Column 20,
Line 1, “use” should read -- use of --; and
Line 34, “has been positioned,” should read -- have been positioned --.

Column 21,
Line 36, “recover” should read -- recovery --.

Column 22,
Line 48, “plat” should read -- plate --.

UNITED STATES PATENT AND TRADEMARK OFFICE

CERTIFICATE OF CORRECTION

PATENT NO. : 6,474,780 B1 
DATED : November 5, 2002
INVENTOR(S) : Masahiko Kubota et al.

It is certified that error appears in the above-identified patent and that said Letters Patent is hereby corrected as shown below:

Column 24,
Line 31, "substrate; and" should read -- substrate; --.

Signed and Sealed this

Twenty-sixth Day of August, 2003

JAMES E. ROGAN
*Director of the United States Patent and Trademark Office*